US007474282B2

(12) United States Patent
Okamoto

(10) Patent No.: US 7,474,282 B2
(45) Date of Patent: Jan. 6, 2009

(54) DISPLAY UNIT OPERATING CONTROL METHOD, DISPLAY CONTROL METHOD, AND DISPLAY APPARATUS

(75) Inventor: Shigetsugu Okamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 335 days.

(21) Appl. No.: 10/470,153

(22) PCT Filed: Jan. 10, 2003

(86) PCT No.: PCT/JP03/00184

§ 371 (c)(1),
(2), (4) Date: Jul. 24, 2003

(87) PCT Pub. No.: WO03/065335

PCT Pub. Date: Aug. 7, 2003

(65) Prior Publication Data

US 2004/0076018 A1 Apr. 22, 2004

(30) Foreign Application Priority Data

Jan. 25, 2002 (JP) ..... 2002-017578

(51) Int. Cl.
*G06G 3/30* (2006.01)

(52) U.S. Cl. ..... 345/76

(58) Field of Classification Search ..... 345/690, 345/212, 214, 84, 76, 82, 89; 315/169.3; 313/498, 500; 257/E51.018; 349/143
See application file for complete search history.

(56) References Cited

U.S. PATENT DOCUMENTS 5,329,288 A * 7/1994 Kim ..... 345/63
6,246,180 B1 6/2001 Nishigaki
6,583,775 B1 6/2003 Sekiya et al.
6,897,855 B1 * 5/2005 Matthies et al. ..... 345/204
7,113,154 B1 9/2006 Inukai
2001/0043168 A1 * 11/2001 Koyama et al. ..... 345/52
2002/0047852 A1 * 4/2002 Inukai et al. ..... 345/629
2003/0169219 A1 * 9/2003 LeChevalier ..... 345/84
2004/0207615 A1 * 10/2004 Yumoto ..... 345/211

FOREIGN PATENT DOCUMENTS

JP 02-257553 10/1990
JP 3-58086 3/1991

(Continued)

*Primary Examiner*—Abbas I Abdulselam
(74) *Attorney, Agent, or Firm*—Nixon & Vanderhye PC

(57) ABSTRACT

A display-unit-use display control method controls display of pixels in a display unit including a large number of light emitting elements in a row direction and a column direction, the light emitting elements having brightness, which changes in accordance with a value of current supplied thereto. A current is supplied, the current supplying conductor from one or each end part thereof in a column direction, the current supplying conductor supplying the current to the light emitting elements. The pixels are displayed line by line in accordance with a selection timing, and the display of pixels is deleted line by line in accordance with a deletion timing. It is so arranged that with respect to a certain line, a period from a time at which the pixels get displayed in accordance with the selection timing to a time at which the display of the pixels gets deleted is shorter than a period between start and end of the selection timing.

17 Claims, 20 Drawing Sheets

FOREIGN PATENT DOCUMENTS

| | | |
|---|---|---|
| JP | 07-318898 | 12/1995 |
| JP | 11-282420 | 10/1999 |
| JP | 11-327506 | 11/1999 |
| JP | 11-344949 | 12/1999 |
| JP | 2000-105575 | 4/2000 |
| JP | 2000-221942 | 8/2000 |
| JP | 2000-221944 | 8/2000 |
| JP | 2000-356963 | 12/2000 |
| JP | 2001-60076 | 3/2001 |
| JP | 2001-343933 | 12/2001 |
| JP | 2002-032037 | 1/2002 |

* cited by examiner

FIG. 10

MAXIMUM CHANGING RATE IΔ (±%) OF ON CURRENT

| | DISPLAY LINE NUMBER | | | |
|---|---|---|---|---|
| TURN-ON RATIO % | 1,080 | 720 | 600 | 480 |
| 5 | 0.0352 | 0.0153 | 0.0105 | 0.00662 |
| 10 | 0.143 | 0.0631 | 0.0435 | 0.0276 |
| 15 | 0.324 | 0.143 | 0.0990 | 0.063 |
| 20 | 0.576 | 0.255 | 0.177 | 0.113 |
| 25 | 0.900 | 0.400 | 0.277 | 0.177 |
| 30 | 1.29 | 0.576 | 0.400 | 0.255 |
| 35 | 2.07 | 0.924 | 0.642 | 0.410 |
| 40 | 3.42 | 1.54 | 1.07 | 0.684 |
| 45 | 4.68 | 2.11 | 1.47 | 0.942 |
| 50 | 5.83 | 2.64 | 1.85 | 1.18 |

ON/OFF RESISTANCE VALUES : Rxon=500k、Rxoff=$10^4$×Rxon
RATIO OF ON RESISTANCE TO ELECTRODE RESISTANCE : Rxon/(R1+R2)=5×$10^5$

FIG. 11

MAXIMUM CHANGING RATE (%) OF ON CURRENT WITH RESPECT TO DISPLAY PATTERN TURN-ON RATIO OF ADJACENT LINES.

| | DISPLAY LINE NUMBER | | | |
|---|---|---|---|---|
| TURN-ON RATIO % | 1,080 | 720 | 600 | 480 |
| 5 | 11.6 | 5.26 | 3.67 | 2.36 |
| 10 | 11.4 | 5.16 | 3.60 | 2.31 |
| 15 | 11.0 | 5.00 | 3.49 | 2.24 |
| 20 | 10.4 | 4.77 | 3.33 | 2.14 |
| 25 | 9.77 | 4.47 | 3.13 | 2.01 |
| 30 | 8.96 | 4.11 | 2.88 | 1.85 |
| 35 | 7.37 | 3.41 | 2.39 | 1.54 |
| 40 | 4.65 | 2.19 | 1.54 | 0.995 |
| 45 | 2.21 | 1.05 | 0.742 | 0.481 |
| 50 | 0.000 | 0.000 | 0.000 | 0.000 |

ON/OFF RESISTANCE VALUES Rxon=500k、Rxoff=$10^4$×Rxon
RATIO OF ON RESISTANCE TO ELECTRODE RESISTANCE Rxon/(R1+R2)=5×$10^5$

FIG. 13

MAXIMUM CHANGING RATE IΔ (±%) OF ON CURRENT

| TURN-ON RATIO % | DISPLAY LINE NUMBER | | | |
|---|---|---|---|---|
| | 1,080 | 720 | 600 | 480 |
| 5 | 0.0352 | 0.0153 | 0.0105 | 0.00662 |
| 10 | 0.143 | 0.0631 | 0.0435 | 0.0276 |
| 15 | 0.324 | 0.143 | 0.0990 | 0.063 |
| 20 | 0.576 | 0.255 | 0.177 | 0.113 |
| 25 | 0.900 | 0.400 | 0.277 | 0.177 |
| 30 | 1.29 | 0.576 | 0.400 | 0.255 |
| 35 | 2.07 | 0.924 | 0.642 | 0.410 |
| 40 | 3.42 | 1.54 | 1.07 | 0.684 |
| 45 | 4.68 | 2.11 | 1.47 | 0.942 |
| 50 | 5.83 | 2.64 | 1.85 | 1.18 |
| 55 | 6.90 | 3.15 | 2.20 | 1.41 |
| 60 | 7.88 | 3.61 | 2.53 | 1.63 |
| 65 | 8.79 | 4.04 | 2.83 | 1.82 |
| 70 | 9.63 | 4.44 | 3.11 | 2.01 |
| 75 | 10.4 | 4.81 | 3.38 | 2.18 |
| 80 | 11.1 | 5.15 | 3.61 | 2.33 |
| 85 | 11.7 | 5.46 | 3.83 | 2.47 |
| 90 | 12.3 | 5.73 | 4.03 | 2.60 |
| 95 | 12.8 | 5.98 | 4.20 | 2.71 |
| 100 | 13.2 | 6.19 | 4.35 | 2.81 |

ON/OFF RESISTANCE VALUES : Rxon=500k、Rxoff=$10^4$×Rxon

RATIO OF ON RESISTANCE TO ELECTRODE RESISTANCE : Rxon/(R1+R2)=5×$10^5$

FIG. 14

MAXIMUM CHANGING RATE K(%) OF ON CURRENT WITH RESPECT TO DISPLAY PATTERN TURN-ON RATIO OF ADJACENT LINES.

| | DISPLAY LINE NUMBER | | | |
|---|---|---|---|---|
| TURN-ON RATIO % | 1,080 | 720 | 600 | 480 |
| 5 | 26.4 | 12.4 | 8.69 | 5.61 |
| 10 | 26.2 | 12.3 | 8.62 | 5.57 |
| 15 | 25.8 | 12.1 | 8.50 | 5.50 |
| 20 | 25.2 | 11.8 | 8.34 | 5.40 |
| 25 | 24.5 | 11.5 | 8.13 | 5.26 |
| 30 | 23.6 | 11.2 | 7.88 | 5.10 |
| 35 | 21.9 | 10.4 | 7.38 | 4.79 |
| 40 | 19.0 | 9.17 | 6.50 | 4.23 |
| 45 | 16.4 | 8.00 | 5.69 | 3.71 |
| 50 | 14.0 | 6.91 | 4.93 | 3.22 |
| 55 | 11.9 | 5.91 | 4.22 | 2.76 |
| 60 | 9.95 | 4.98 | 3.57 | 2.34 |
| 65 | 8.19 | 4.13 | 2.96 | 1.95 |
| 70 | 6.61 | 3.35 | 2.40 | 1.58 |
| 75 | 5.18 | 2.64 | 1.89 | 1.25 |
| 80 | 3.89 | 1.99 | 1.43 | 0.941 |
| 85 | 2.73 | 1.40 | 1.01 | 0.664 |
| 90 | 1.70 | 0.874 | 0.630 | 0.415 |
| 95 | 0.794 | 0.408 | 0.294 | 0.194 |
| 100 | 0.000 | 0.000 | 0.000 | 0.000 |

ON/OFF RESISTANCE VALUES : Rxon=500k、 Rxoff=$10^4 \times$Rxon

RATIO OF ON RESISTANCE TO ELECTRODE RESISTANCE : Rxon/(R1+R2)=$5 \times 10^5$

FIG. 16

ELECTRODE RESISTANCE

| | | | RESISTANCE PER PIXEL Ω | |
|---|---|---|---|---|
| SYMBOL | MATERIAL | SHEET RESISTANCE Ω/□ | STRIPE ELECTRODE | FLAT ELECTRODE |
| R1 | ITO | 100Ω/□ | 300Ω | $5.21 \times 10^{-2}$ Ω |
| R2 | ALUMINUM | $2.69 \times 10^{-2}$ Ω/□ | $3.23 \times 10^{-1}$ Ω | $1.40 \times 10^{-5}$ Ω |

DISPLAY UNIT OPERATING CONTROL METHOD, DISPLAY CONTROL METHOD, AND DISPLAY APPARATUS

This application is the US national phase of international application PCT/JP03/00184 filed 10 Jan. 2003 which designated the U.S.

TECHNICAL FIELD

The present invention relates to a lighting control method and a display control method for a display unit in which light emitting elements of a current drive type, such as electro luminescence (EL) elements or the like are used, and to a display apparatus. Specifically, the present invention relates to a method for alleviating unevenness in brightness in a screen in the display unit.

BACKGROUND ART

In a display unit in which light emitting elements of a current drive type such as organic EL elements, inorganic EL elements or the like are used as pixels, brightness of each pixel depends on how much a current passing through each light emitting element is. Thus, for attaining even brightness, the display unit is so arranged that voltage conditions of active elements are so controlled that the currents passing through the respective lighting elements are approximately equal.

In case of a display unit of an active matrix type, having an image display section (display screen) in which a number of pixels are arrayed vertically and horizontally, a current is supplied to a light emitting element of each pixel via a current supplying line from a power source, and the current is discharged to a common electrode (ground) via a current discharging line from each light emitting element.

Here, the current supplied to each light emitting element depends on a length of the current supplying line from the power source to the light emitting element or a length of the current discharging line, because of resistance loss on the way.

FIG. 20 illustrates how positions of the light emitting elements relate with current values to be supplied to the light emitting elements, in case the currents are supplied from edge part of the display screen to the light emitting elements via the current supplying lines. Note that in the following the positions of the light emitting elements are indicated by "node numbers" allotted in an ascending order from center part to the edge part. Hereinafter, the current value to be supplied to the light emitting elements are referred to as "node current values".

FIG. 20 shows that the node current values are smaller as the node numbers descend. In short, the edge part of the display screen, in which the node numbers are greater, is displayed brightly, while the center part of the display screen, in which the node numbers are smaller, is displayed darkly.

In order to reduce a difference between the current values in the edge part and the central part of the display screen, the current supplying lines and the current discharging lines may be made of a highly conductive material having a small relative resistance. However, transparent electrodes such as ITO (Indium Tin Oxide) or the like are generally used in either the current supplying lines or the current discharging lines, so that light from the light emitting elements will be allowed to pass through to outside. The transparent electrodes have a greater relative resistance than the highly conductive metal such as copper, aluminum, and the like. Therefore, there is a limit to the reduction of the difference between the current values.

Moreover, a driving load caused by a plurality of the light emitting elements respectively connected to the current supplying lines is changed according to how many light emitting elements are turned ON. Thus, the node current values may be changed according to how many light emitting elements are turned ON.

For example, discussed below is a case where the currents are supplied from upper edge part and lower edge part of the display screen to each light emitting element, while the central part of the image display section is not turned ON, as shown in FIG. 21. In this case, the light emitting elements that are in a column A are all turned ON. Meanwhile each end part of the light emitting elements that are in a column B is turned ON while each central part thereof is turned OFF. Node current values supplied to the light emitting elements in the columns A and B in this case are shown in FIG. 22. Referring to FIG. 22, the node current values of the columns at a node number are compared with each other. In the area in which both the light emitting elements in column A and column B are turned ON, the node current values in column B are greater than those in column A. Therefore, as shown in FIG. 23, the turned-ON areas above or under the turned-OFF area have a greater brightness than the turned-ON area on the right or on the left of the turned-OFF area.

The following are known as arts of preventing such unevenness in brightness. Japanese Publication of Unexamined Patent Application, Tokukaihei, No. 11-282420 (Date of Release: Oct. 15, 1999), Japanese Publication of Unexamined Patent Application, Tokukaihei, No. 11-327506 (Date of Release: Nov. 26, 1999), and Japanese Publication of Unexamined Patent Application, Tokukaihei, No. 11-344949 (Date of Release: Dec. 14, 1999), disclose arts in which signal data respectively applied on pixels are corrected in accordance with unevenness between light emitting elements in terms of brightness (that is, unevenness between supplying currents).

However, in those arts, a display apparatus additionally requires means for storing each correction value of the light emitting elements. This results in a large circuit size of the display apparatus.

Moreover, Japanese Publication of Unexamined Patent Application, Tokukai, No. 2000-221994 (Date of Release: Aug. 11, 2000) discloses an art in which numbers of light emitting pixels are counted per scanning electrode, and pulse widths of scanning pulse voltages to be applied on the scanning electrodes are set according to the numbers of the light emitting pixels. According to this art, it is possible to reduce unevenness in brightness due to a difference in the numbers of light emitting pixels between adjacent scanning electrodes.

However, in this art, a display apparatus additionally requires means for counting the numbers of the light emitting pixels, and means for changing the pulse widths of the scanning pulse voltages. This results in a large circuit size of the display circuit.

DISCLOSURE OF INVENTION

The present invention, which has been made so as to solve the forgoing problems, has an object to provide (i) a display-unit-use lighting control method and a display-unit-use display control, which reduce unevenness in brightness without resulting in a large circuit size and without being dependent on contents of an image displayed, and (ii) a display apparatus.

In order to attain the object, a display-unit-use lighting control method of the present invention for a display unit including (i) a large number of electro-optic elements arrayed, the electro-optic elements having brightness that changes in accordance with a value of a current supplied thereto, and (ii) one or more power supplying conductors, connected to the electro-optic elements, for supplying power to the electro-optic elements, the lighting control method controlling lighting of the electro-optic elements, is so arranged that the lighting of the electro-optic elements is so controlled that an upper limit of a ratio (hereinafter, referred to as a turn-ON ratio) of (A) the electro-optic elements turned ON among the electro-optic elements connected respectively to the one or more power supplying conductors to (B) the total electro-optic elements connected respectively to the one or more power supplying conductors will be a predetermined value that is less than 100%.

Here, light emitting elements such as LEDs (light emitting Diodes), EL elements, and the like are examples of the electro-optic elements.

According to the method, driving load of the plurality of electro-optic elements is reduced, because the turn-ON ratio is limited to less than 100%. Because of this, it is possible to suppress unevenness in the values of the current to be supplied to the electro-optic elements, without being dependent on contents of an image displayed. Thus, it is possible to alleviate the unevenness in brightness.

Moreover, a display-unit-use display control method of the present invention, of controlling display of pixels in a display unit of a matrix type including a large number of electro-optic elements arrayed in a column direction and a row direction, the electro-optic elements having brightness that changes in accordance with a value of a current supplied thereto, and receiving power through one or more power supplying conductors so as to display the pixels that respectively correspond to the electro-optic elements, in order to display an image of one screen, is so arranged that each of the one or more power supplying conductors supplies power to the electro-optic elements, from one end part or each end part thereof in the column direction; display scanning for displaying the image of one screen is carried out by (i) displaying, at once or one by one, the pixels aligned in one line in the row direction, and (ii) repeating the displaying, for the pixels that aligned in other lines in the row direction; deletion scanning for deleting the image of one screen is carried out by (iii) deleting, at once or one by one, the pixels aligned in one line in the row direction, and (iv) repeating the deleting, for the pixels that aligned in other lines in the row direction; and the display of the pixels is so controlled that a ratio of a pixel display period to a display scanning period will be a predetermined value that is less than 100%, the display scanning period being between start and end of the display scanning, and the pixel display period being between start of the display of a certain pixel by the display scanning and deletion of the display of the certain pixel by the deletion scanning.

In a case where all the electro-optic elements connected to the one or more power supplying conductors are turned ON in displaying an image of one whole screen by the display scanning in the display unit of the matrix type, the turn-ON ratio is 100% when all the electro-optic elements are turned ON. For attaining a turn-ON ratio of less than 100%, the turning-ON is carried out with the display timing and deletion timing so controlled not to turn on all the electro-optic element any time.

In short, the turn-ON ratio of less than 100% can be attained by starting the deletion scanning for deleting the display, after the start of the display scanning and before scanning of all the lines are ended. In this case, the display scanning period is shorter than the pixel display period.

According to the above method, it is possible to keep the turn-ON ratio at the predetermined value of less than 100%, by controlling the display of the pixels in order that the ratio of the pixel display period to the display scanning period may be at the predetermined value of less than. 100%. Thus, it is possible to alleviate the unevenness in brightness, without being dependent on the contents of the image displayed.

Moreover, it is possible to perform the deletion scanning, for example, by outputting, to the pixel on which display is carried out by the display scanning, (i) an image signal that is independent of an image signal indicative of turning-OFF after the pixel display period, or a deletion signal. Therefore, it is possible to alleviate the unevenness in brightness by additionally providing simple process means. Thus, it is possible to prevent giving such large circuit size to the display apparatus including the display unit and the control means for performing the display scanning and the deletion scanning.

Furthermore, a display apparatus of the present invention is provided with (a) a display unit including (i) a large number of electro-optic elements arrayed, the electro-optic elements having brightness that changes in accordance with a value of a current supplied thereto, and (ii) one or more power supplying conductors, connected to the electro-optic elements, for supplying power to the electro-optic elements, and (b) lighting control means for controlling lighting of the electro-optic elements, wherein the lighting control means is means for controlling lighting of the electro-optic element so that an upper limit of a ratio of (A) the electro-optic elements turned ON among the electro-optic elements connected respectively to the one or more power supplying conductors to (B) the total electro-optic elements connected respectively to the one or more power supplying conductors will be a predetermined value that is less than 100%.

According to the above arrangement, in which the lighting control means limits the turn-ON ratio to be less than 100%, driving load of the plurality of electro-optic elements is reduced. Hereby, it is possible to suppress unevenness in the values of the current to be supplied to the electro-optic elements, without being dependent on contents of an image displayed.

A display apparatus of the present invention is provided with (i) a display unit of a matrix type including a large number of electro-optic elements arrayed in a column direction and a row direction, the electro-optic elements having brightness that changes in accordance with a value of a current supplied thereto, and receiving power through one or more power supplying conductors so as to display the pixels that respectively correspond to the electro-optic elements, in order to display an image of one screen, and (ii) display control means for controlling the display of the pixels by the display unit, wherein each of the one or more power supplying conductors supply power to the electro-optic elements, from one end part or each end part thereof in the column directions; the display control means including (a) display scanning means for performing display scanning for displaying the image of one screen by (i) displaying, at once or one by one, the pixels aligned in one line in the row direction, and (ii) repeating the displaying, for the pixels that aligned in other lines in the row direction; (b) deletion scanning means for performing deletion scanning for deleting the image of one screen by (iii) deleting, at once or one by one, the pixels aligned in one line in the row direction, and (iv) repeating the deleting, for the pixels that aligned in other lines in the row direction; and (c) deletion scanning control means for controlling the deletion scanning means so that a ratio of a pixel display period to a display scanning period will be a predetermined value that is less than 100%, the display scanning period being between start and end of the display scanning, and the pixel display period being between start of the display of a certain pixel by the display scanning and deletion of the display of the certain pixel by the deletion scanning.

In the above arrangement, the display control means performs the display control so that the ratio of the pixel display period to the display scanning period will be at the predetermined value of less than 100%. Hereby, as described above, the upper limit of the turn-ON ratio is limited by the predetermined value. Thus, it is possible to alleviate the unevenness in brightness without being dependent on the content of the image displayed.

Moreover, the control of the pixel display period can be attained by additionally providing a simple process, as described above. Thus, it is possible to prevent giving such large circuit size to the display apparatus.

For a fuller understanding of the nature and advantages of the invention, reference should be made to the ensuing detailed description taken in conjunction with the accompanying drawings.

BRIEF DESCRIPTION OF DRAWINGS

FIG. 8 is a graph illustrating relationship between a current changing rate and a ratio of (i) an ON resistance of a resistant element to (ii) a sum of resistances of the transparent electrode and the aluminum electrode and.

FIG. 10 is a table showing, for each display line number, maximum values of current changing rate for each turn-ON ratio.

FIG. 11 is a table showing, for each turn-ON ratio and display line, maximum changing rate of a current that changes depending on a display pattern between adjacent lines.

FIG. 13 is a table showing, for each display line number, maximum values of current changing rate for turn-ON ratio, in the comparative example.

FIG. 14 is a table showing, for each turn-ON ratio and display line, maximum changing rate of a current that changes depending on a display pattern in an adjacent line, in the comparative example.

FIG. 16 is a table showing various resistances of the aluminum electrodes, and the transparent electrodes made of ITO.

BEST MODE FOR CARRYING OUT THE INVENTION

First Embodiment

Figure 1:
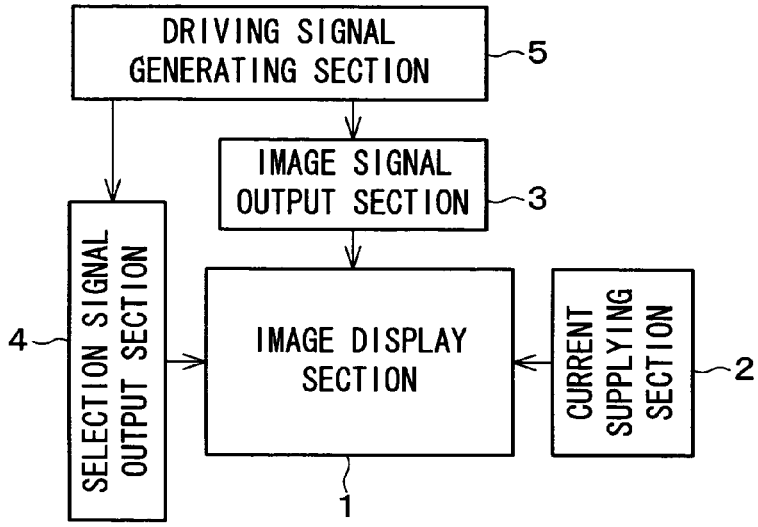
FIG. 1 is a block diagram schematically illustrating an arrangement of an organic EL display apparatus of an embodiment of the present invention.

In the following, an embodiment of the present invention is explained referring to FIGS. 1 to 14. FIG. 1 illustrates a schematic arrangement of an organic EL display apparatus of the present embodiment. The organic EL display apparatus is provided with an image display section 1 (display unit), a current supplying section 2, an image signal output section 3, a selection signal output section 4, and a driving signal generating section 5.

The image display section displays an image by using organic EL elements as pixels, the organic EL elements being light emitting elements. The current supplying section 2 supplies a current to the organic EL elements. The image signal output section 3 outputs an image signal to the image display section 1. The selection signal output section 4 outputs a selection signal for selecting the pixel of the image display section 1 to which the image signal is outputted. The driving signal generating section 5 generates drive signals for driving the image signal output section 3 and the selection signal output section 4, respectively, and outputs the drive signals to the image signal output section 3 and the selection signal output section 4, together with an externally inputted synchronizing signal and the image signal.

Figure 2:
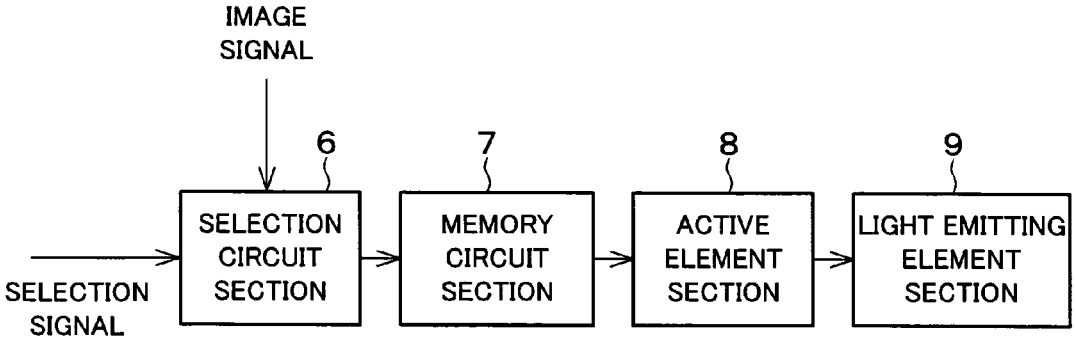
FIG. 2 is a block diagram schematically illustrating an arrangement of each pixel in an image display section shown in FIG. 1.

In the present embodiment, the image display section 1 is a display unit of an active matrix type, in which a large number of pixels are arrayed in a column direction and a row direction, and is provided with an active element for turning ON and OFF each pixel. Each pixel is, as shown in FIG. 2, provided with a selection circuit section 6, a memory circuit section 7, an active element section 8, and a light emitting element 9.

The selection circuit 6 receives the selection signal from the selection signal output section 4, and selects, in accordance with the selection signal, whether or not the selection circuit will obtain the image signal. In case the selection circuit section 6 obtains the image signal, the memory circuit section 7 stores the image signal therein. The active element section 8 controls lighting of the light emitting element section 9 in accordance with the image signal stored in the memory circuit section 7.

Figure 3:
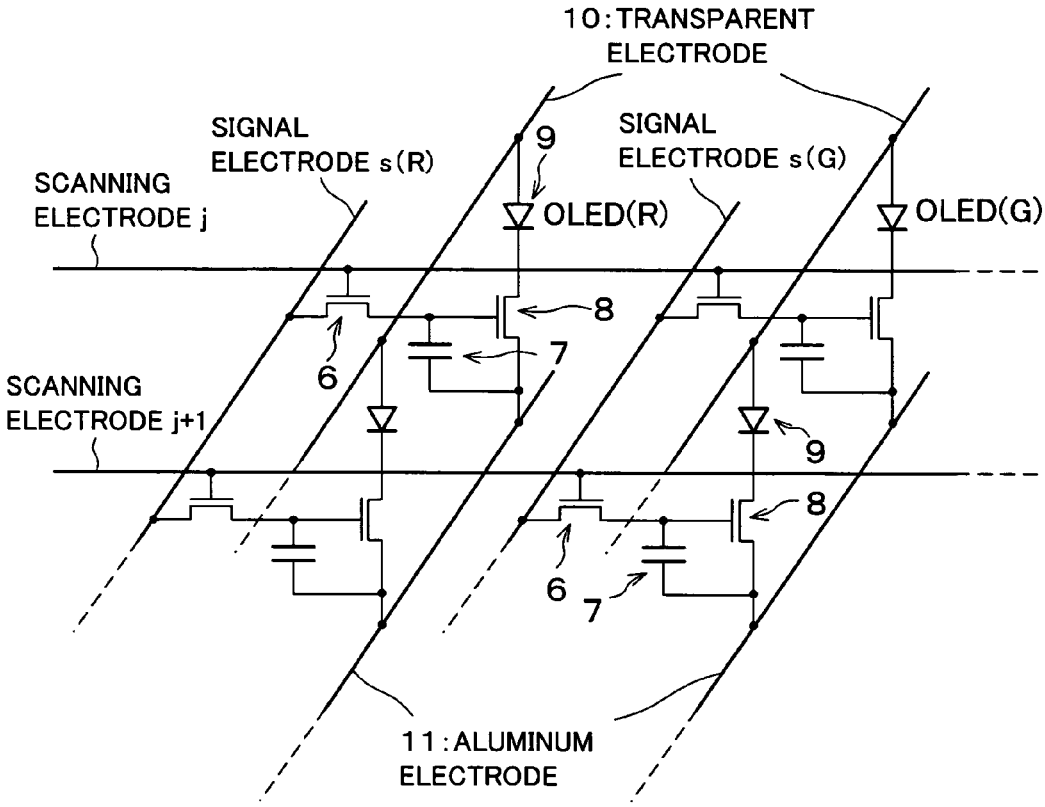
FIG. 3 is a circuit diagram more specifically illustrating the arrangement of each pixel shown in FIG. 2.

FIG. 3 specifically illustrates a circuit configuration of the pixels. The current from the current supplying section 2 is sent via transparent electrodes 10 and returned via aluminum (Al) electrodes 11. Provided between the transparent electrodes 10 and the aluminum electrodes 11, are light emitting elements OLED, each of which is the light emitting element section 9, and TFTs (Thin Film Transistor), each of which is the active element section 8. In short, the transparent electrodes 10 and the aluminum electrodes 11 serve as power supply-use electrodes 10 and 11 for supplying power to the light emitting element sections 9.

The image signal from the image signal output section 3 is inputted via signal electrodes 2 into the TFTs, each of which serves as the selection circuit section 6. The selection signal from the selection signal output section 4 is inputted into gates of the TFTs 6 via scanning electrodes j, and j+1. Therefore, when the selection signal is of H (high) level, the image signal is inputted via the TFTs 6 into capacitors, each which serves as the memory circuit section 7.

The capacitors 7 accumulate an electric charge in accordance with the image signal inputted therein. Hereby, a voltage according to the thus accumulated electric charge is generated in the capacitors 7. The voltage is applied into the gates of the TFTs, which serve as the active element sections 8. Therefore, when the voltage becomes equal to or higher than a threshold value, the current flows from the transparent electrodes 10 through the light emitting elements OLED and the TFTs 8 to the aluminum electrodes 11, thereby causing the light emitting elements OLED to emit light.

In the present embodiment, as shown in FIG. 3, the light emitting elements OLED connected to the same signal electrodes emit light of the same color. Specifically, in the present embodiment, the pixels for the same color are aligned along a direction of the signal electrodes s. Thus, the preset embodiment has an RGB stripe arrangement in which pixels for red (R), green (G), and blue (B) are alternately arrayed along a direction of the scanning electrode j. As to color arrangement of the pixels, the present invention may have an arbitrary arrangement such as a delta arrangement. Moreover, the present invention may have monochrome display whose display colors are black and white.

The transparent electrodes 10 are made of a conductive electrode having a transparent property for light, for example, ITO. As discussed above, in order to suppress unevenness in brightness, it is preferable that the transparent electrodes and the aluminum electrodes 11 have a low resistance. In short, it is preferable that both the transparent electrodes 10 and the aluminum electrodes 11 are made of a material having a high conductivity. Moreover, both the transparent electrodes 10 and the aluminum electrodes 11, which are formed in stripe in the present embodiment, preferably have a flat structure formed in a flat shape.

FIG. 16 illustrates sheet resistances, and resistances per pixel, of ITO and aluminum, in case those materials are made into stripe electrodes, and in case those materials are made into flat electrodes. According to FIG. 16, it is understood that ITO has a resistance higher than a highly conductive metal such as aluminum by 1000 times or more. Therefore, it is especially preferable that the transparent electrodes have the flat structure.

Figure 4A:
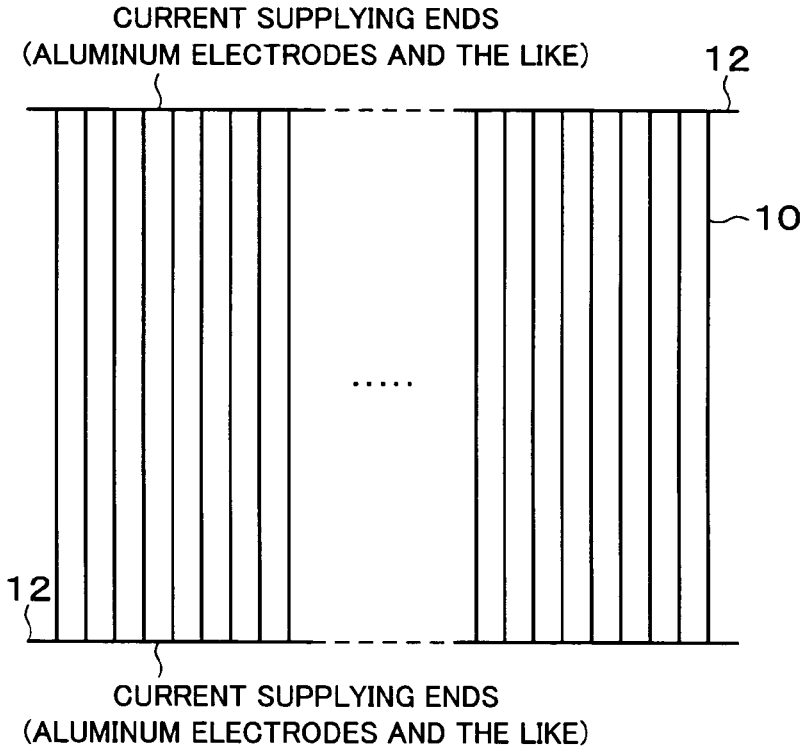
FIG. 4(*a*) is a schematic diagram showing an electrode arrangement of transparent electrodes shown in FIG. 3, while FIG. 4(*b*) is a schematic diagram showing an electrode arrangement of aluminum electrodes shown in FIG. 3.
Figure 4B:
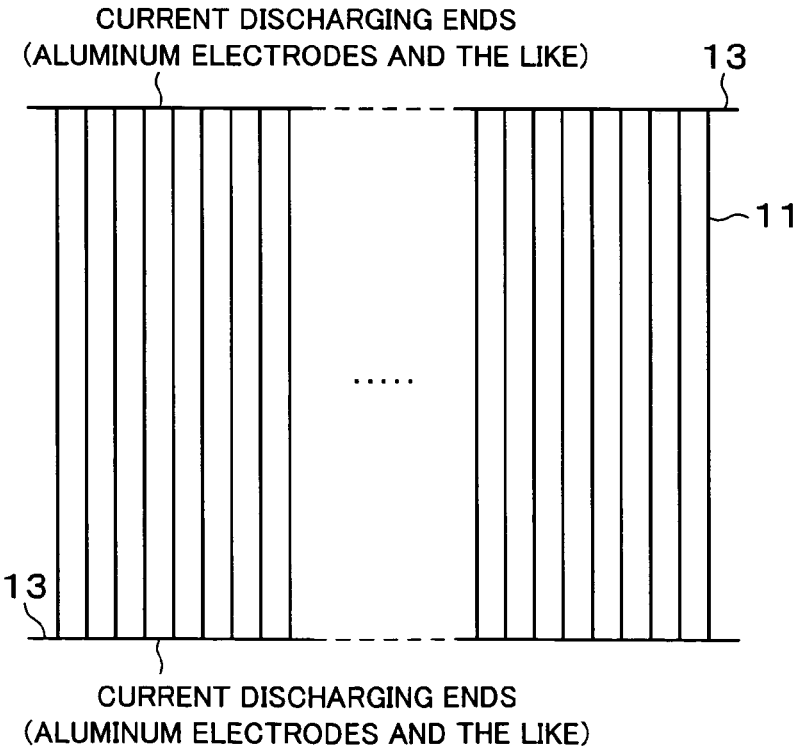

As shown in FIG. 4(*a*), each end 12 (hereinafter referred to as "current supplying ends") of the transparent electrodes 10 arrayed in parallel to the signal electrodes s is connected with each other by using a metal material having high conductivity, such as aluminum or the like. Similarly, as shown in FIG. 4(*b*), each end 13 (hereinafter referred to as "current discharging ends") of the aluminum electrodes 11 arrayed in parallel to the signal electrodes s, is connected with each other by using a metal material having a high conductivity. The current supplying ends 12 and the current discharging ends 13 are connected to the current supplying sections 2 via metal lines (not shown) having a high conductivity.

The organic EL display apparatus of the present embodiment controls a ratio of the pixel display period to a display scanning period, in order to suppress unevenness in brightness. In the following, the unevenness in brightness is discussed in detail.

To begin with, distribution of the current to be supplied to the light emitting elements 9 from the current supplying section 2 is discussed. The metal lines that connect the current supplying section 2 with the current supplying ends 12 and current discharging ends 13 may be so arranged as to have a cross sectional area significantly larger than the transparent electrodes 10 and the aluminum electrodes 11. Therefore, the metal lines may be so arranged as to have a significantly low resistance. Therefore, it is possible to suppose that the current supplying section 2 is directly connected with the current supplying ends 12 and the current discharging ends 13, by ignoring the resistances of the metal lines.

Moreover, as shown in FIGS. 4(*a*) and 4(*b*), it is so illustrated that the transparent electrodes 10 and the current supplying ends 12 are positioned in vertical symmetry, and the aluminum electrodes 11 and the current discharging ends 13 are also positioned in vertical symmetry. Thus, the current distribution is considered to be in vertical symmetry. This means that it is enough to consider only either the current distribution from the upper ends to center part or that from the lower ends to the center part.

Figure 5:
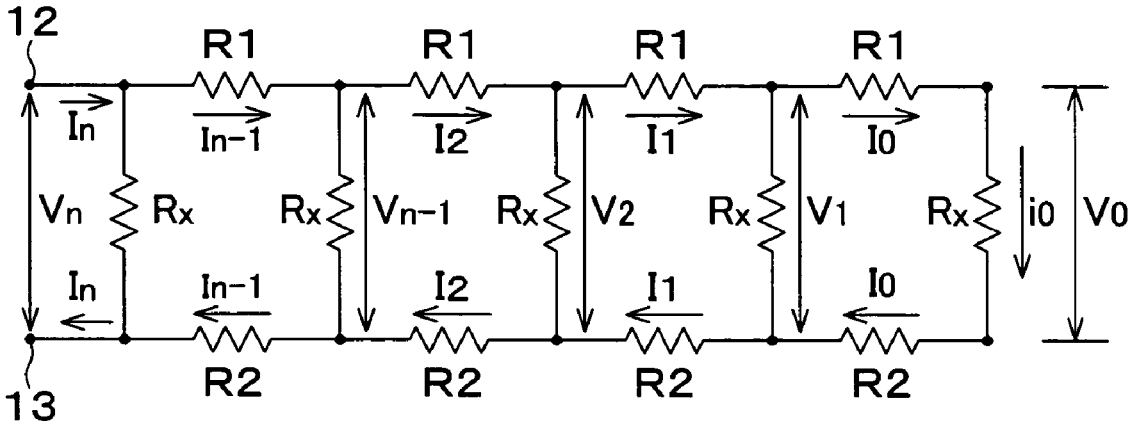
FIG. 5 is a circuit diagram illustrating a circuit configuration including the transparent electrodes, the aluminum electrodes, which are shown in FIGS. 3 and 4, active element sections, and light emitting element sections.

Moreover, for examining distribution of the current flowing through the light emitting elements 9, it is possible to suppose that the circuit constituted of the plurality of light emitting elements 9 and the TFTs 8, which are connected between the transparent electrodes 10 and the aluminum electrodes 11, is a multi-staged ladder-type circuit constituted of resistance elements, as shown in FIG. 5.

In FIG. 5, the right hand side is center part of the image display section 1 and the left hand side is upper end part or lower end part of the image display section 1. Resistors R1 are resistances of the transparent electrodes 10 between adjacent pixels, while resistance elements R2 are resistances of the aluminum electrodes 11 between adjacent pixels. If the transparent electrodes 10 and the aluminum electrodes 11 have a flat structure, the resistance elements R1 and R2 are resistances that are in accordance with distances between adjacent pixels.

Each resistance element $R_x$ is a sum of the resistance of the light emitting element 9 and that of the TFT 8 in each pixel. Therefore, the resistance elements $R_x$ have two types of values: an ON resistance $R_{xon}$ for a case where the light emitting element is turned ON; and an OFF resistance $R_{xoff}$ for a case where the light emitting element is turned OFF.

Note that the resistance elements $R_x$ of the light emitting elements 9 and the TFTs 8 are changed in accordance with the current values, because in reality the resistance elements $R_x$ have non-linear voltage-current characteristics. Therefore, it is necessary to calculate out the resistance elements $R_x$ from the current values that are in accordance with driving voltages respectively applied onto the resistance elements $R_x$, in order to exactly calculate the resistor $R_x$.

However, the object of the present invention is to reduce the unevenness in brightness in a display apparatus. In case of the organic EL display apparatus, this corresponds to suppression in changing rate in current flowing through the light emitting elements 9.

Therefore, the inventor of the present application compared (i) maximum values of the changing rate in case where the resistance elements $R_x$ are fixed values, and (ii) maximum values of the changing rate in case where the non-linear characteristics are taken in consideration. As a result, it was found that both of the values are substantially equal when the driving voltage applied onto each the resistance element $R_x$ is within a range within which the driving voltage is used in reality.

Therefore, in the following explanation, it is supposed that the two kinds of resistances $R_{xon}$ and $R_{xoff}$, which the resistances elements $R_x$ may have, are fixed values.

Note that the circuits include, in reality, components of transient response, such as a capacitor component, an active component, and the like. However, discussed here is distribution of the brightness in case a turning-ON state and turning-OFF state of the light emitting elements exist steadily alternatively according to scanning selection. Therefore, the circuits can be expressed only by direct current components, while ignoring the components of transient response.

In examining current dependency between the circuit including certain one of the transparent electrodes 10 and the circuit including another one of the transparent electrodes 10, it may be supposed such that the resistance elements are connected to the current supplying ends 12 and the current discharging ends 13. For approximation, electrode resistances at a node end associating a current source in FIG. 5 (the left hand side of FIG. 5) are set in accordance with a distance from current source node.

In FIG. 5, it is very complicated to calculate the current distribution in each pixel, from a current supplying side (the left hand side in FIG. 5). For this reason, supposing that a current having a current value io flows into the resistance element Rx that is connected to a node 0 at a center, it is possible to easily express, in the following recurrence formula, the voltages and currents at the resistance element Rx connected to each node:

$$V_0=R_x\times I_0, I_0=i_0,$$

$$V_1=(R_1+R_2)\times I_0+V_0, I_1=I_0+V_1/R_x,$$

$$V_2=(R_1+R_2)\times I_1+V_1, I_2=I_1+V_2/R_x,$$

$$V_3=(R_1+R_2)\times I_2+V_2, I_3=I_2+V_3/R_x,$$

$$V_n=(R_1+R_2)\times I_{n-1}+V_{n-1}, I_n=I_{n-1}+V_n/R_x \quad (1).$$

Supposing a node number of the current supplying side is N, a set current is at the node 0 at the center at which an input voltage $V_n=V_{in}$ is recalculated to obtain a value expressed in the following equation:

$$I_0=i_s=(V_{in}/V_0)\times i_0 \quad (2).$$

By carrying out calculation of Equation (1) by using the current value $I_0=i_s$, current distribution and voltage distribution caused by a certain input voltage are calculated out. In evaluating a current ratio or a voltage ratio of each node, it is possible to omit Equation (2) if the values of the resistance element $R_x$ is not dependent on the voltages.

Calculated out next is a current value of each node for a case where the light emitting elements 9 of all the nodes are turned ON, that is, for a case where all the resistance elements $R_x$ are of $R_{xon}$. Thereby, a maximum value $I_{max}$ and a minimum value $I_{min}$ thereof are obtained. Then, as shown by the following equation, an average value between the maximum value $I_{max}$ and the minimum value $I_{min}$ is denoted as a reference current value $I_B$:

$$I_B=(I_{max}+I_{min})/2 \quad (3).$$

Further, a current changing rate ΔI from the reference current value $I_B$ is calculated by the following equation:

$$\Delta I = \pm(I_{\max}/I_b - 1) \quad (4)$$

$$= \pm(I_{\max} - I_{\min})/(I_{\max} + I_{\min}).$$

In case of an EL element, it is possible to calculate out the brightness of the light emitting elements, as a value substantially proportional to the current value. Hereby, the changing rate of the current corresponds to a changing rate of the brightness.

Figure 20:
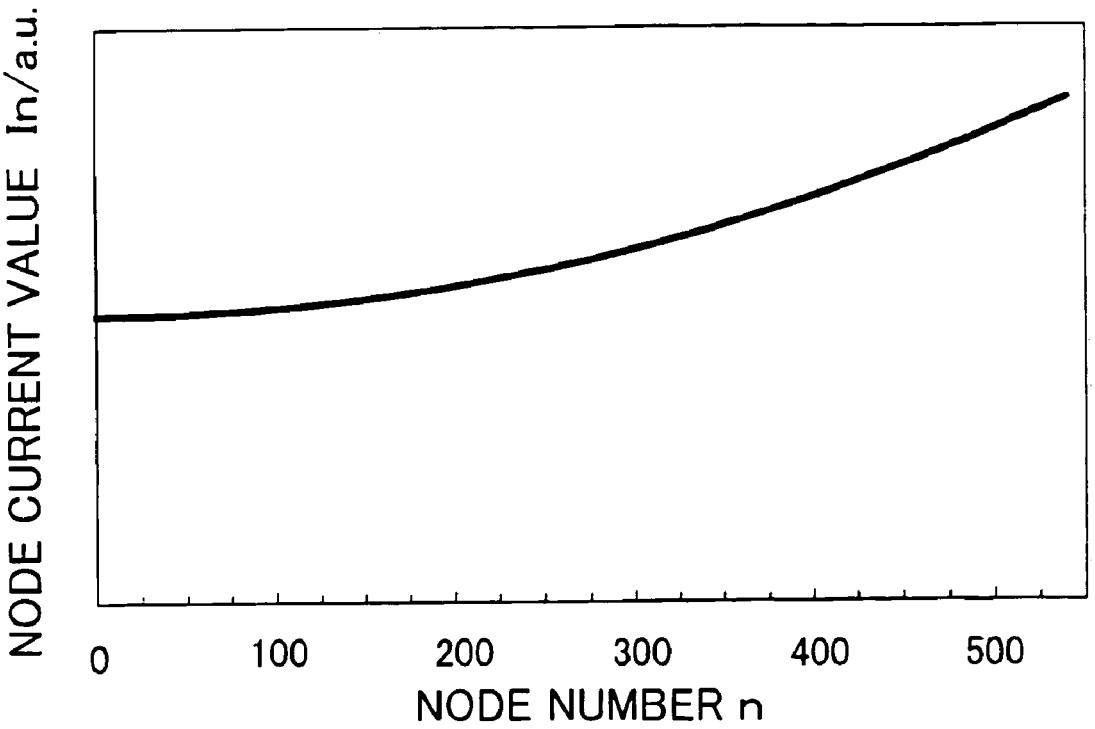
FIG. 20 Background Art
FIG. 20 is a graph showing relationship between positions of light emitting elements, and values of currents to be supplied to the light emitting elements. The positions of the light emitting elements are indicated by the node numbers, while the current values of the light emitting elements are indicated by the node current values.

FIG. 20 illustrates the current distribution worked out by calculating the current value of each node for the case where the light emitting elements 9 of all the nodes are turned ON, that is, for the case where all the resistance elements $R_x$ are of $R_{xon}$. In FIG. 20, the left hand side is center part of the pixel, and the right hand side is end part of the pixel. Therefore, the distribution of the current flowing through the light emitting element 9 of each pixel has an earthenware mortar-like shape whose end part is higher and whose center part is lower.

Figure 21:
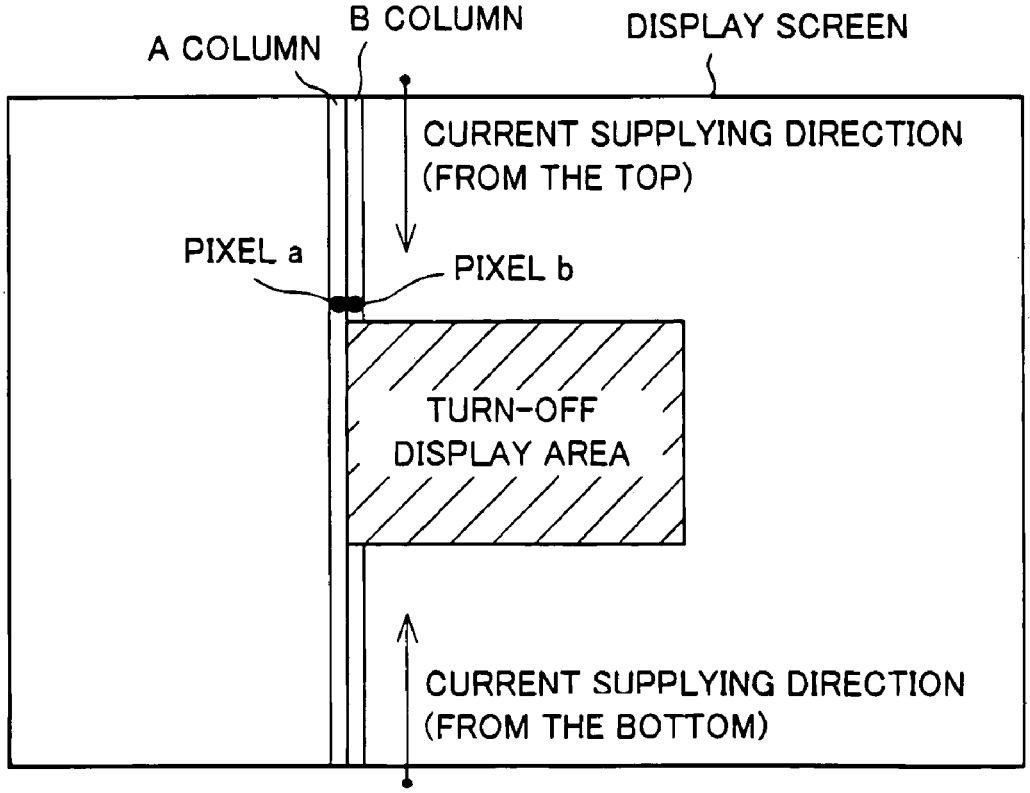
FIG. 21 Background Art
FIG. 21 is a schematic diagram showing an image having a turn-OFF display area at a center of a screen.
Figure 22:
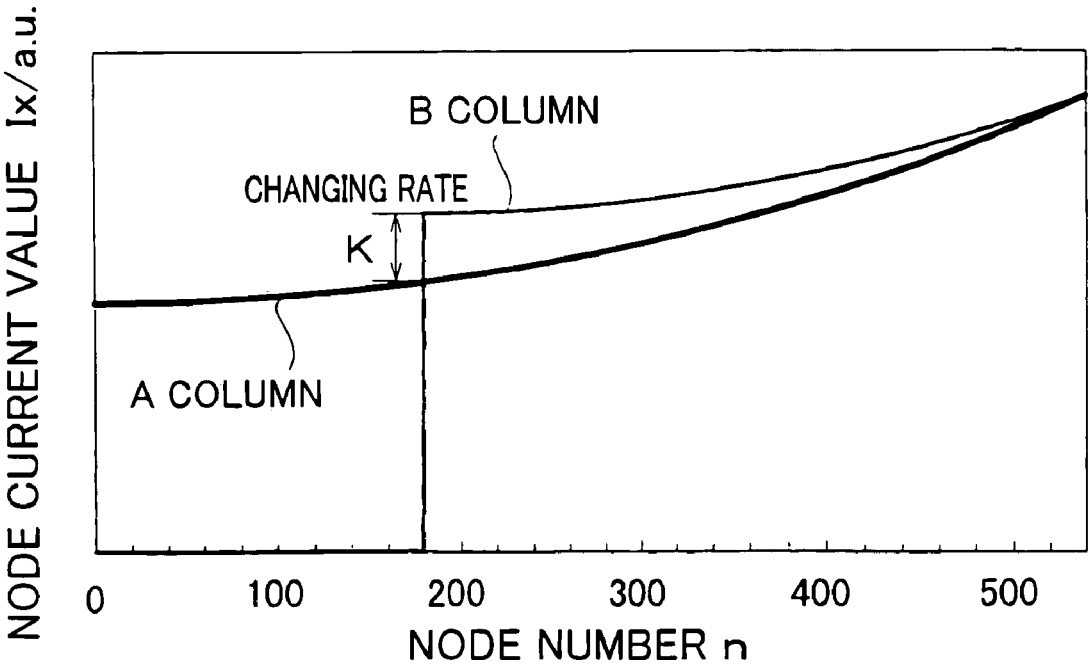
FIG. 22 Background Art
FIG. 22 is a graph showing relationship between positions of light emitting elements and values of currents to be supplied to the light emitting elements in case where the image shown in FIG. 21 is displayed on a conventional display apparatus. The positions of the light emitting elements are indicated by the node numbers, while the current values of the light emitting elements are indicated by the node current values.
Figure 23:
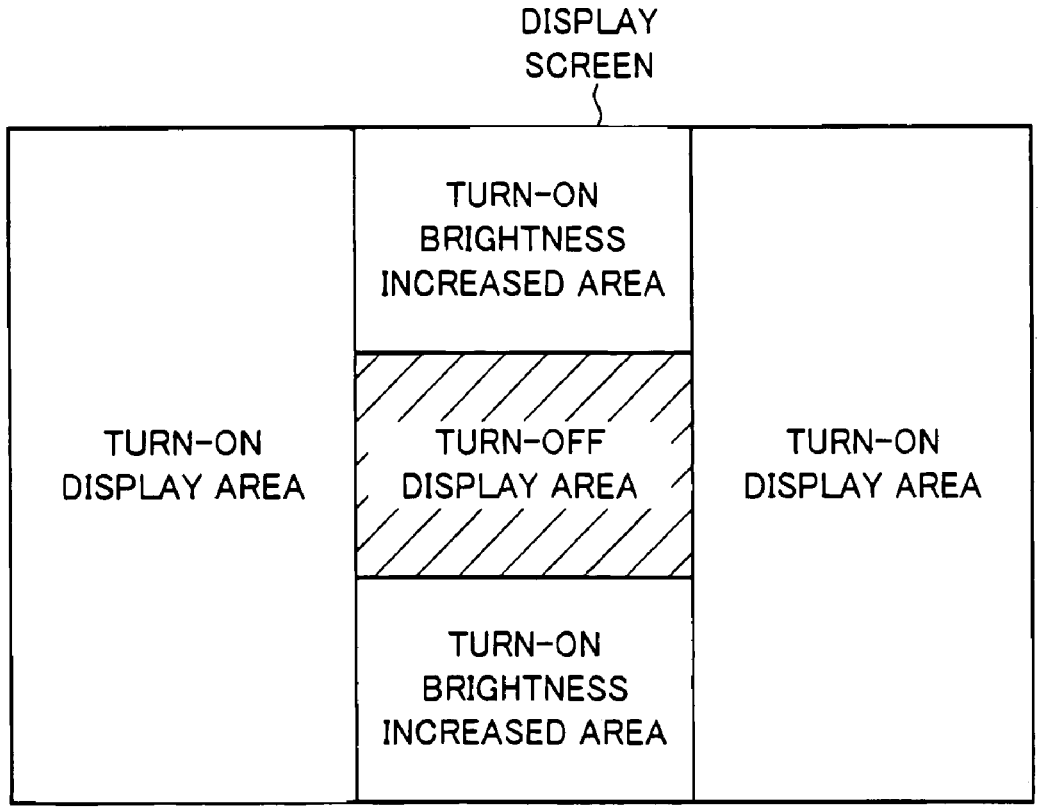
FIG. 23 Background Art
FIG. 23 is a schematic diagram showing that unevenness in brightness is caused on the screen when the image shown in FIG. 21 is displayed, in the conventional display apparatus.

As described above, FIG. 20 shows an example of unevenness of the brightness. Meanwhile, FIGS. 21 to 23 illustrate other examples. Specifically, when a number of the light emitting elements 9 connected to a transparent electrode 10 and turned ON is different from that of the light emitting elements 9 connected to an adjacent transparent electrode 10 and turned ON, the currents flowing the light emitting elements 9 connected to the transparent electrodes 10 adjacent to each other are different in value. This causes uneven brightness.

For example, as shown in FIG. 21, where a central part is in the turned-OFF state, while part surrounding the central part is in the turned-ON state, the brightness above and under the central part is increased as shown in FIG. 23. Such partial highness and partial lowness of brightness are changed in accordance with loading condition, that is, with the number of the turned-ON light emitting elements 9. Therefore, analytic expression is necessary for exact gradation display.

Next, by using the above equations, calculated out is a maximum value K of a current changing rate between a pixel column A including the light emitting elements 9 connected to a transparent electrode 10, and a pixel column B including the light emitting elements 9 connected to an adjacent transparent electrode 10, as shown in FIG. 21.

To begin with, it is supposed that a display scanning period be one field period (1/60 second), and a ratio (hereinafter referred to as "display ratio") of a pixel display period for one field period is D. In this case, in each pixel column, a ratio of pixels that are in a display state, to all the pixels is also D.

Next, as to the pixel column A, it is supposed that all-turned-ON display is performed for one field period (1/60 second). Here, the "all-turned-ON display" denotes such display that every light emitting element 9 is turned ON at least once during the one field period. In this case, at an arbitrary time, a turn-ON ratio of the pixel column A is D, equal to the display ratio.

On the other hand, it is supposed that the pixel column B performs such display that the turning-ON is carried out arbitrarily. Incidentally, pixels in the turn-ON state are always in a display state, while pixels in the display state are not always in the turn-ON state. Therefore, a turn-ON ratio X of the pixel column B at an arbitrary time is not more than the display ratio D.

Figure 6:
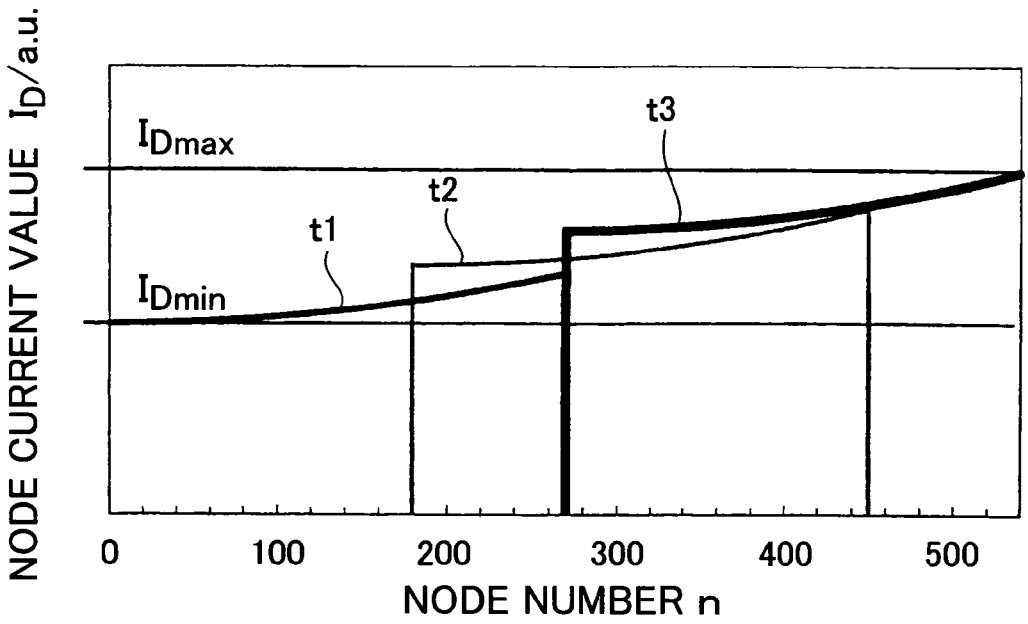
FIGS. 6 and 7 are graphs illustrating relationship between positions of light emitting elements and values of currents to be supplied to the light emitting elements in the present embodiment. The positions of the light emitting elements are indicated by node numbers, and the current values of the light emitting elements are indicated by node current values.

FIG. 6 illustrates distribution of node current value ID flowing nodes (light emitting elements 9) at times $t_1$, $t_2$, and $t_3$, with respect to the pixel column A. A maximum value $I_D$ of the node current value $I_D$ is denoted as $I_{Dmax}$ and a minimum value thereof is denoted as $I_{Dmin}$. Here, it is supposed that the voltages to be applied between the current supplying ends 12 and the current discharging ends 13 are constant. Thus, the node current value at an arbitrary time is always in a range between the minimum value $I_{Dmin}$ and the maximum value $I_{Dmax}$.

Moreover, FIG. 6 illustrates how the turn-ON area (display area) is moved as the time lapses from $t_1$, $t_2$, to $t_3$ within one field period. It is possible to realize the all-turned-ON display by performing display scanning so that the turn-ON area will be moved from the first pixel to the last pixel within one field period.

Figure 7:
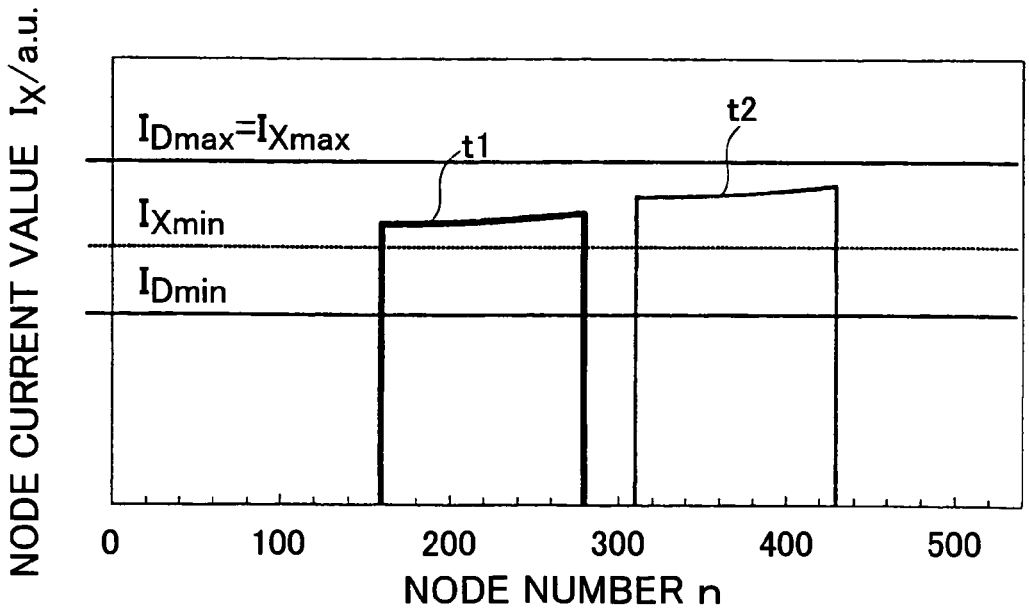
Figure 8:
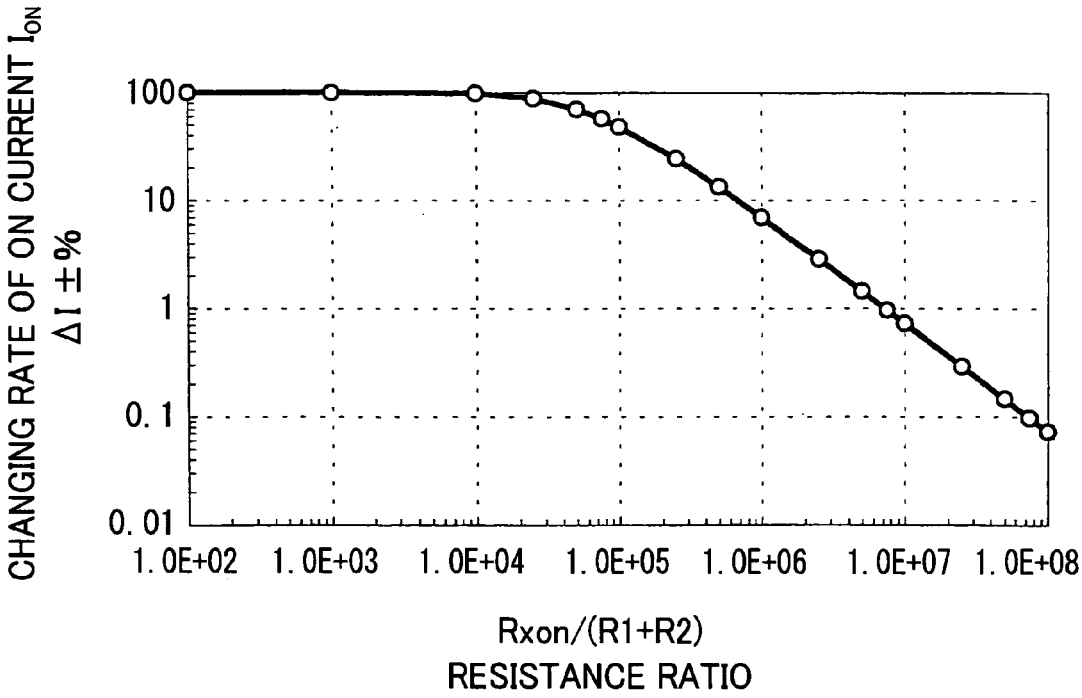

On the other hand, FIG. 7 illustrates distribution of a node current value $I_x$ for a case where only a particular area in the pixel column B is turned ON in one field period. Regardless of where the particular area is, for example at the center part or at the edge part, the node current value $I_x$ is within a range between a maximum value $I_{xmax}$ and a minimum value $I_{xmin}$. Moreover, because the turn-ON ratio X of the pixel column B is not more than the turn-ON ratio D of the pixel column A, a difference between the maximum value $I_{xmax}$ and the minimum value $I_{xmin}$ of the pixel column B is not more than a difference between a maximum value $I_{Dmax}$ and a minimum value $I_{Dmin}$ of the pixel column A.

Further, when the display scanning is so performed that the particular area is moved from the first pixel to the last pixel in one field period, attained is the same effect as achieved by performing the all-tuned-ON display in the pixel column B at the display ratio X.

A reference current value $i_D$ of the node current value $I_D$ in the pixel column A, and a reference current value $i_x$ of the node current value $I_x$ in the pixel column B, are respectively expressed as the following equations according equation (3):

$$i_D=(I_{Dmax}+I_{Dmin})/2,$$

$$i_X=(I_{Xmax}+I_{Xmin})/2 \quad (5).$$

By using equations (4) and (5), a current changing rate A in the pixel column A and a current changing rate B in the pixel column B are respectively expressed as the following equations:

$$A=(I_{Dmax}-i_D)/i_D,$$

$$B=(I_{Xmax}-i_X)/i_X \quad (6).$$

Therefore, a maximum value K of the current changing rate of the pixel columns A and B adjacent to each other is expressed as the following equation:

$$K=(I_{X\min}-I_{D\min})/i_D \quad (7)$$

$$=2\times(A-B)/(B+1).$$

Note that, $I_{Dmax}=I_{xmax}$ is utilized in order to derive equation (7). This is because the constant voltage is applied between the current supplying end 12 and the current discharging end 13 so that the current flowing into the light emitting element 9 of that pixel to which a voltage equivalent to that voltage is applied, that is, which is most close to the current supplying end 12, is maximum.

Next, equations (1), (2), and (3) are calculated by using, as a parameter for substitution, a resistance ratio of (i) the resistance elements $R_x$ of a pixel, $R_x/(R_1+R_2)$, to (ii) a sum $R_1+R_2$ (hereinafter the sum is referred to as "electrode resistance") of an inter-pixel resistance $R_1$ of the transparent electrodes 10 and an inter-pixel resistance $R_2$ of the aluminum electrodes 11. Here, even though the sum of the inter-pixel resistances $R_1$ and $R_2$ of the transparent electrodes 10 and aluminum electrodes 11 is used, it may be so arranged as to simplify the equations by supposing $R_1=R_2$ as to $R_1+R_2$, and using $R_x/R_1$, a ratio of $R_x$ to $R_1$, as the parameter.

Moreover, in the present embodiment, $R_{xoff}/R_{xon}$, a ratio of the OFF resistance $R_{xoff}$ to the ON resistance $R_{xon}$ in the resistance elements $R_x$ is $10^4$, compared with current voltage characteristics of the active element 8, and the like characteristics. However, an arbitrary value may be set as this value. This is because the current changing rate is hardly changed even if the resistance ratio $R_{xoff}/R_{xon}$ is changed, as long as the resistance ratio $R_x/(R_1+R_2)$ is constant and the current changing rate with respect to the ON resistance $R_{xon}$ is discussed.

Moreover, the larger the resistance $R_{xoff}/R_{xon}$ is, the higher a ratio of bright/dark contrast. This does not make direct contribution to improvement in the brightness distribution when display is performed by turning ON a full screen. Thus, there is no problem to ignore this in the preset embodiment.

From the study discussed above, a graph shown in FIG. 8 was obtained by calculating the current changing rate ΔI where the display was performed by turning ON the full screen throughout one field period by using, as the parameter, the resistance ratio $R_{xon}/(R_1+R_2)$, which is the ratio of the $R_{xon}$ of the resistance elements $R_x$ with respect to the electrode resistance $R_1+R_2$, that is, where the turn-ON ratios of all the pixel are 100%. According to FIG. 8, it is understood that, in order to keep the current changing rate ΔI within ±10% where the turn-ON ratio is 100%, it is necessary that the resistance ratio $R_{xon}/(R_1+R_2)$ is $10^6$ or more.

The following explains what is actually meant by the resistance ratio $R_{xon}/(R_1+R_2)$ of $10^6$ or more. For example, in case of an HDTV (High-Definition television) having a screen size of as much as 15 inches (1920×1080×3(RGB) pixels), one pixel is about 60 μm×170 μm. Here, if aluminum electrodes having a 1 μm thickness and a 10 μm width are used as the current supplying electrodes, electrode resistances between pixels are about 0.465 Ω.

On the other hand, ON resistances $R_{xon}$ of the resistance elements $R_x$ of the pixels are a sum of ON resistances of active elements sections 8 and ON resistances of light emitting element sections 9, and depend on condition of a voltage, a size of the active elements 8, light emitting efficiency of the light emitting element sections 9, and the like. For example, the ON resistances of the active element sections 8 are several 10 k to several 100 kΩ, and the ON resistances of the light emitting element sections 9 are several 100 k (in case of low light emitting efficiency) to several MkΩ (in case of high light emitting efficiency), in case where the active elements sections 8 and the light-emitting elements 9 are formed on a polysilicon substrate, which is used very often in manufacture of screens such as liquid crystal display apparatuses, organic EL display apparatuses, and the like. Therefore, the ON resistance $R_{xon}$ of the resistance elements $R_x$ of the pixel are as much as several 100 k to several MΩ. In the following explanation, it is supposed that $R_{xon}$ is 500 kΩ.

Therefore, the resistance ratio $R_{xon}/(R_1+R_2)$ is in a range of $10^5$ and $10^6$. From this, it is understood that the resistance ratio $R_{xon}/(R_1+R_2)$ is significantly lower than $10^6$ when transparent electrodes having a larger resistivity than the aluminum electrode are used. Therefore, it is understood that, in a screen arrangement of the HDTV having 1080 number of scanning electrodes, in case where current supplying ends 12 are provided on both upper end part and lower end part of the screen, it is difficult in reality to keep a current changing rate within ±10% only by means of an arrangement of the electrodes.

Next, explained is a driving method of the image display in the present embodiment. The driving method of the present embodiment is such a driving method that after a period half of the a display scanning period is passed since an image is displayed on a certain scanning electrode by display scanning, the image on the scanning electrode is deleted.

Figure 9:
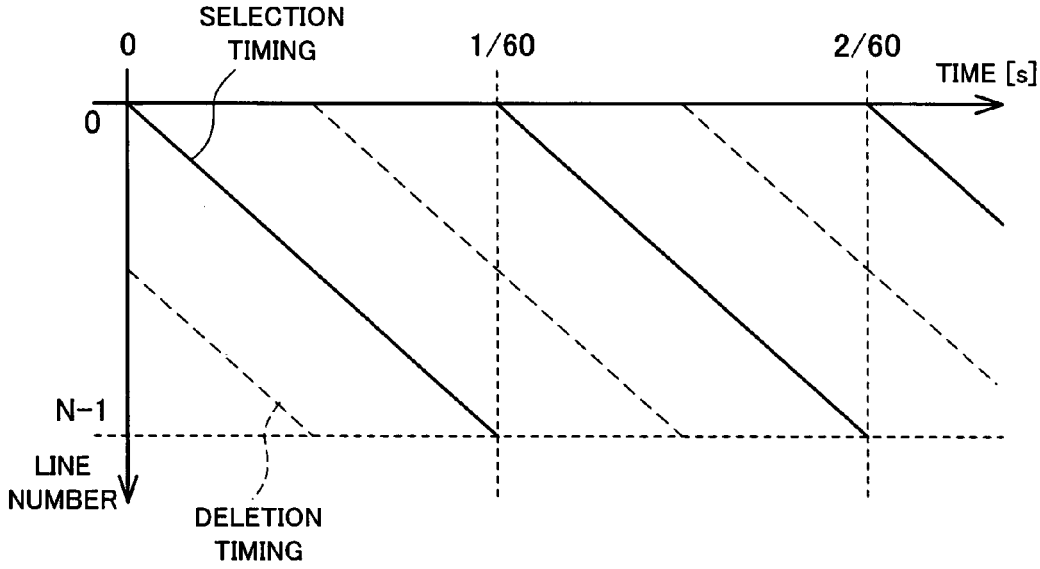
FIG. 9 is a graph showing a selection timing and a deletion timing to be inputted into each scanning electrodes in the present invention.

FIG. 9 illustrates a selection timing and a deletion timing for input of the selection signal and a deletion signal from the selection signal output section 4 into the respective scanning electrodes, in the driving method. In a graph in FIG. 9, the abscissa axis is time, and the axis of ordinate is line numbers 0 to (N−1) of scanning electrodes of an N number. The selection timing is indicated in a solid line, while the deletion timing is indicated in a broken line.

Here, the selection signal is a signal for selecting that scanning electrode which displays the image. The deletion signal is a signal for selecting that scanning electrode on which the image is deleted. Moreover, in the present embodiment, a vertical scanning period is one field period (1/60 second). Thus, after 1/120 second from a time at which the image on the scanning electrode is displayed by inputting the scanning signal into the scanning electrode, the image on the scanning electrode is deleted by inputting the deletion signal into the scanning electrode.

According to FIG. 9, the scanning signal is inputted from a start time of one field, and the image is display, line by line, starting from the scanning electrode of line no. 0. Then, after 1/120 second from the start time of one field, the deletion signal is inputted so as to delete the image line by line, starting from the scanning electrode of line no. 0.

Moreover, according to the graph of FIG. 9, at 1/60 second, no image is displayed on those pixels which are connected to the scanning electrodes of line numbers 0 to (N−1)/2, meanwhile the image is displayed on those pixels which are connected with the scanning electrodes of line no. N/2 to N−1. Specifically, with respect to the power supply-use electrodes 10 and 11 that are vertical to the scanning electrodes, half of the pixels connected to the power supply-use electrodes 10 and 11 are in the display state, and the rest of the pixels are in a non-display state (turn-OFF state). That is, a display ratio is 50%, and turn-ON ratio is 50% or less. Hereby, the number of the pixels connected to the power supply-use electrodes 10 and 11 and turned ON is kept to be less than or equal to the total number of the pixels.

In the above arrangement, supposing that $R_{xon}/(R_1+R_2)$ is $5\times10^5$, a maximum value of a current changing rate ΔI is calculated for each turn-ON ratio, by using the equations (1) to (4). FIG. 10 is a table showing the maximum values. Moreover, by using equation (5), calculated for each turn-ON ratio is a maximum value of a current changing ratio K in pixel columns adjacent to each other and connected to adjacent current supplying electrodes. FIG. 11 is a table showing the maximum values.

According FIG. 10, for example, in the display apparatus whose number of scanning line is 1080, it is understood that a current changing of ±5.83% is caused in the screen in case where white display (state in which all the pixels are turned ON) is performed on the screen, that is, in case where the turn-ON ratio is 50%. Moreover, according to FIG. 11, for example where the turn-ON ratio of the pixel columns A and B are respectively 50% and 5%, it is understood that a current change of 11.6% at maximum is caused between the pixels adjacent to each other in the adjacent pixel columns A and B.

COMPARATIVE EXAMPLE

Figure 12:
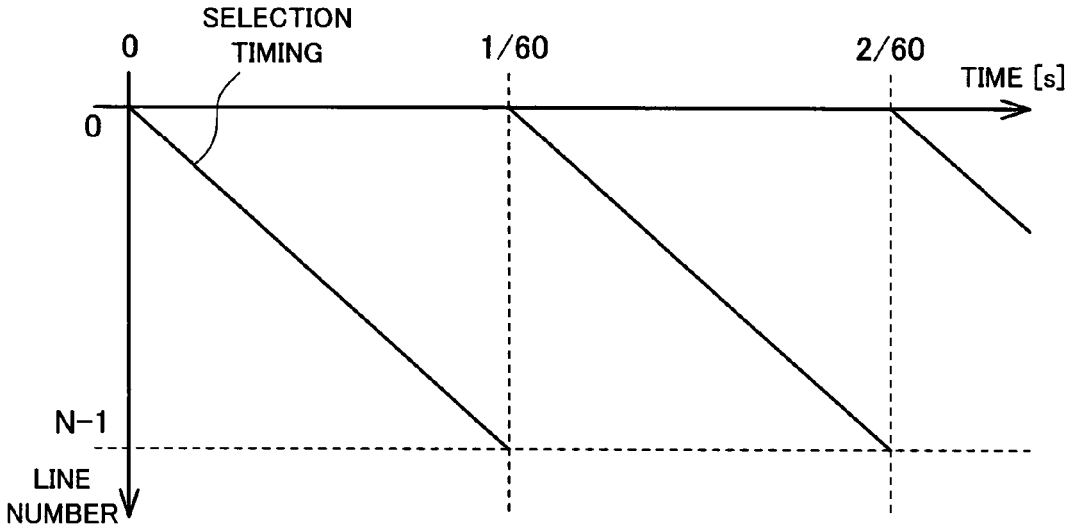
FIG. 12 is a graph illustrating a selection timing to be inputted into each scanning electrode in a comparative example for the present embodiment.

Next, a comparative example for the above embodiment is explained. FIG. 12 shows the selection timing in the comparative example. It is explicitly shown by comparison of FIG. 12 with FIG. 9 that no deletion signal is inputted in the comparative example, differently from the above embodiment. Other features of the comparative example are the same as the above embodiment. In this case, all the pixels are always in a display state, that is, a display ratio is 100%.

In the above arrangement, supposing that a resistance ratio $R_{xon}/(R_1+R_2)$ was $5\times10^5$, maximum values were worked out for each turn-ON ratio. The maximum values of current changing rates ΔI are shown in a table of FIG. 13. Moreover, by using equation (5), maximum values of current changing rates K of adjacent pixel columns connected to adjacent current supplying electrodes were worked out for each turn-ON ratio. The maximum values of current changing rates K are shown in a table of FIG. 14.

According to FIG. 13, for example, in the display apparatus having 1080 scanning lines, it is understood that a current changing of ±13.2% is caused in a screen in case where white display (state in which all the pixels are turned ON) is performed on the screen, that is, in case where the turn-ON ratio is 100%. Moreover, according to FIG. 14, for example where the turn-ON ratio of the pixel columns A and B are respectively 100% and 5%, it is understood that a current change of 26.4% at maximum is caused between the pixels adjacent to each other in the adjacent pixel columns A and B.

Therefore, in the display apparatus of the present embodiment, which has a smaller current change, compared with a display apparatus of the comparative example, it is possible to suppress the unevenness in brightness.

Second Embodiment

Figure 15:
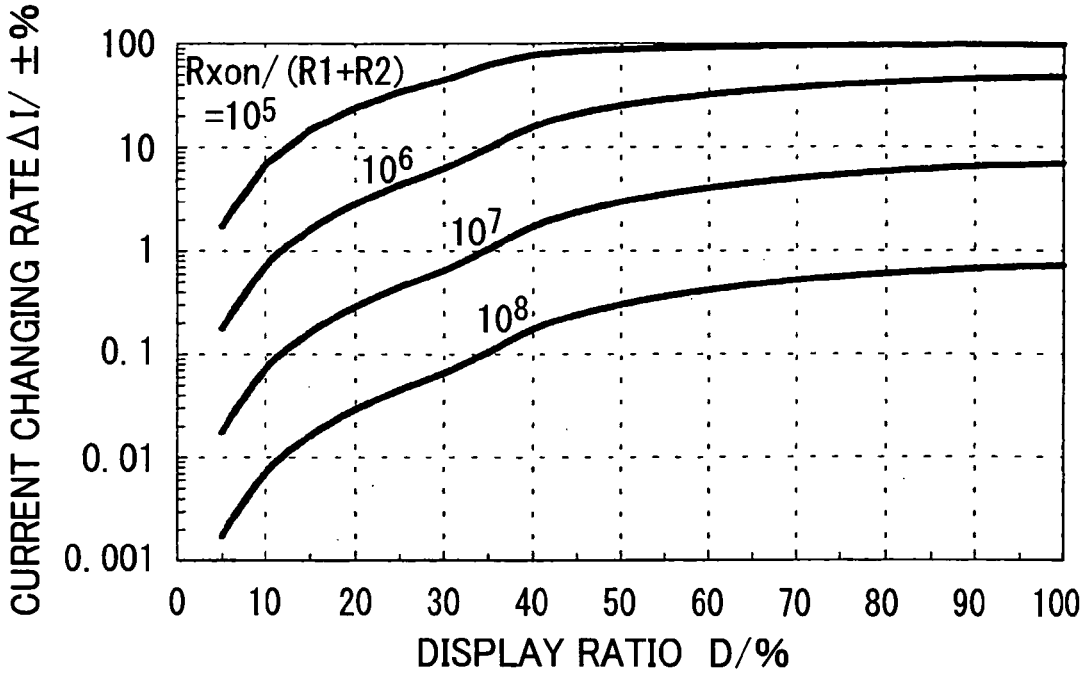
FIG. 15 is a graph illustrating how the current changing rate is changed as a display ratio is changed.
Figure 17:
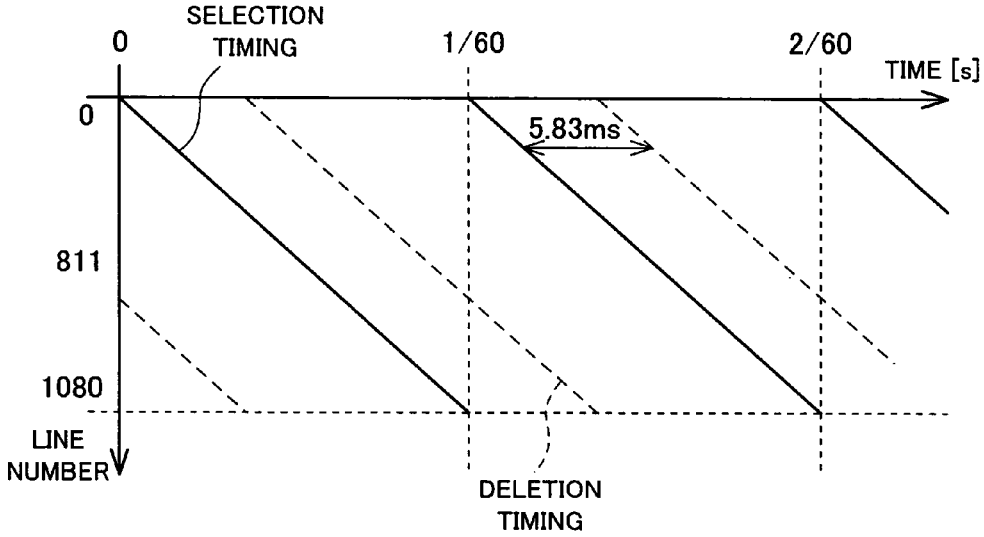
FIG. 17 is a graph showing a selection timing and a deletion timing to be inputted into each scanning electrodes in another embodiment in the present invention.

Next, another embodiment of the present invention is explained according to FIGS. 15 to 17. A display apparatus of the present embodiment has a different method of driving image display from the display apparatus of the above embodiment, but is identical to the display apparatus of the above embodiment in terms of the other arrangements.

Before explaining the method of driving the image display of the present embodiment, explained is setting values of electrode resistance $R_1+R_2$ between pixels, and display ratio D, necessary for suppressing a current changing rate ΔI within ±5%, in case where an ON resistance $R_{xon}$ of resistance elements $R_x$ is 500 kΩ. Note that the display apparatus exemplified here is the organic EL display apparatus having 1080 scanning electrodes shown in the above embodiment.

By using equations (1) to (4), current changing rates were calculated for cases where the display ratio D was changed, supposing that the ON resistance $R_{xon}$=500 kΩ. The calculation gave the graph shown in FIG. 15.

In FIG. 15, the curves are respectively for resistance ratios $R_{xon}/(R_1+R_2)$ of $10^5$, $10^6$, $10^7$, and $10^8$. According to FIG. 15, the electrode resistance should be $R_1+R_2 \leqq 5.00\times10^{-2}$ Ω, in order to have a current changing rate ΔI±5% or less.

Here, it is supposed that ITO electrodes 10 are used as current supplying electrodes, and aluminum electrodes 11 are used as current discharging electrodes. FIG. 16 shows resistances of the ITO electrodes 10 and the aluminum electrodes 11.

Where the ITO electrodes 10 has a sheet resistance of 100 Ω/□ (square) and the aluminum electrodes 11 having 1 μm thickness has $2.69\times10^{-2}$ Ω/□ (calculated from a resistivity of $2.69\times10^{-2}$ Ω at 300K), supposing that the aluminum electrodes 11 have a width that is a quarter of that of the pixels, the electrode resistance $R_1+R_2$ between pixels is evaluated as about 300Ω when both the electrodes 10 and 11 are in a stripe shape, and about $3.75\times10^{-1}$Ω when the ITO electrodes 10 are flat, according to calculation based on FIG. 16.

Namely, in order to have the current changing rate of ±5% or less, it is necessary that the electrode resistance $R_1+R_2$ be $5.00\times10^{-2}$ or less. Further, in order to have a higher ON resistance of light-emitting electrodes, and to be capable of selecting a material of good lighting efficiency, it is necessary to use a resistance larger substantially by one digit or more. For this reason, in a display driving method in which the display ratio D=100%, it is necessary that the ITO electrodes having a large resistance be thicker by 10 times so as to further reduce the inter-electrode resistance. However, there is a possibility that the thicker ITO electrodes may leads to deterioration of transmissivity.

On the other hand, in order to have the current changing rate of ±5% or less, it is another option to have a smaller display ratio D, while keeping the resistance $R_1+R_2$ at $3.75\times10^{-1}$Ω as currently being as such. In this case, the resistance ratio $R_{xon}/R_1+R_2$ is $1.33\times10^6$. Thus, it is understood that the display ratio D should be about 35% or less, according to FIG. 15.

As described above, in the present embodiment, the driving method, which attains the display ratio D of about 35% is used. To attain the display ratio D of about 35%, an image on a scanning electrode is deleted within a period of about 35% of a display scanning period from a time at which the image is displayed on the scanning electrode by display scanning.

FIG. 17 illustrates the selection timing and the deletion timing in a case of use of the driving method. In the graph of the FIG. 17, the abscissa axis is time, and the axis of ordinate is line numbers 1 to 1080 of 1080 scanning electrodes. The selection timing is indicated by solid lines, while the deletion timing is indicated by broken lines.

According to FIG. 17, a selection signal is inputted from a starting time of one field, so as to display an image line by line from the scanning electrode of line no. 1. Then, a deletion signal is inputted after about 5.83 millisecond from the starting time of one field, so as to delete the image line by line from the scanning electrode of line no. 1.

Therefore, the display apparatus of the present embodiment can have a current changing rate further reduced compared with the above embodiment, and is capable of surely suppressing unevenness in brightness.

Figure 18:
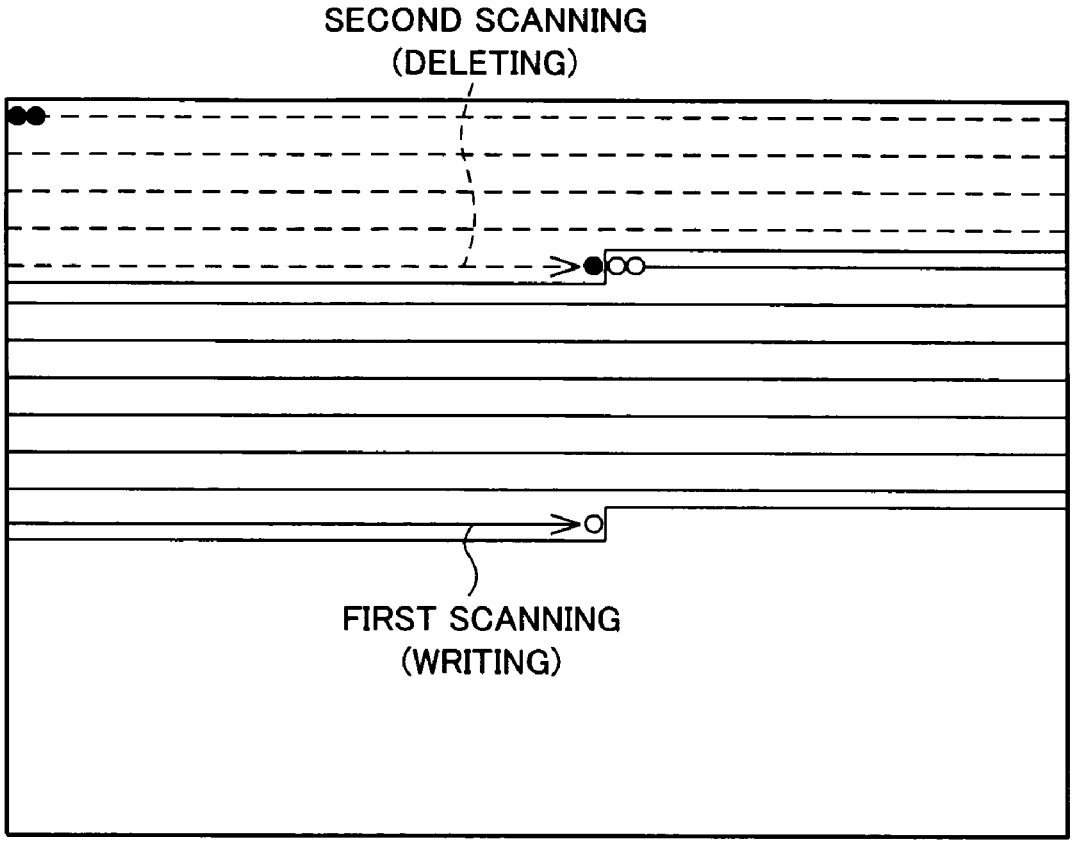
FIG. 18 is a schematic diagram illustrating how the selection timing and the deletion timing shown in FIG. 17 are carried out by point-by-point scanning.

While the line-by-line scanning for displaying or line-by-line deleting of the image is performed in FIG. 17, this may be adopted to point-by-point scanning for displaying or deleting an image pixel by pixel, as shown in FIG. 18. In FIG. 18, the image is displayed pixel by pixel by first scanning, and the image is deleted pixel by pixel by second scanning.

Figure 19:
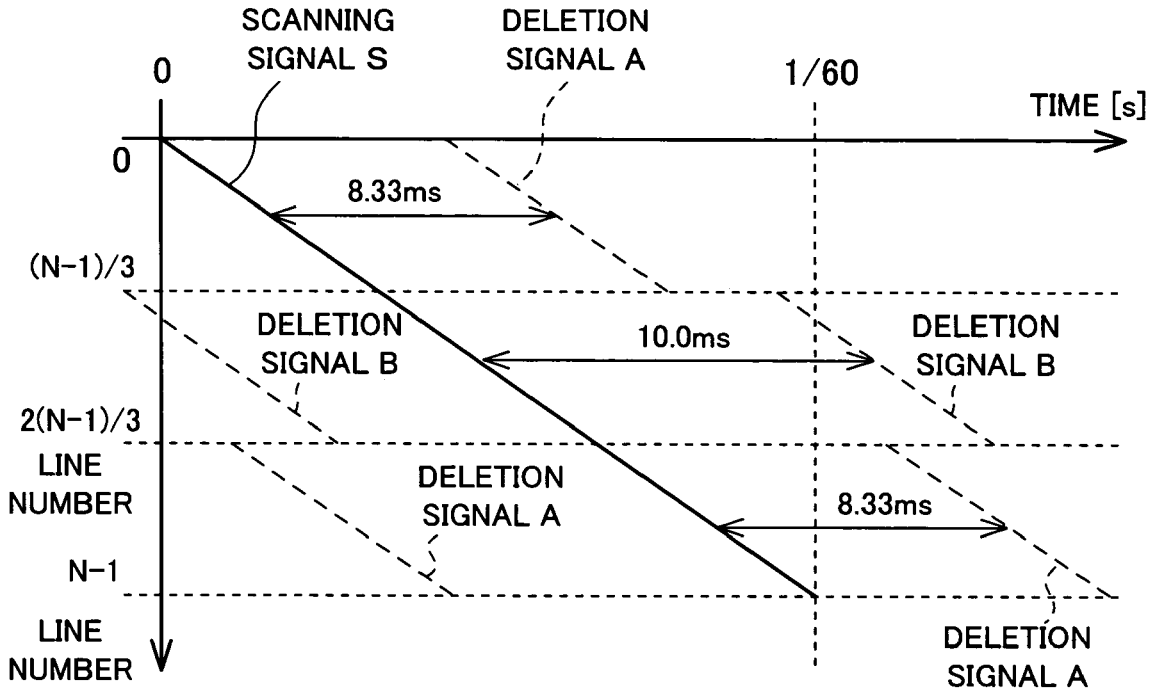
FIG. 19 is a graph showing a selection timing and a deletion timing to be inputted into each scanning electrode, in still another embodiment of the present invention.

Moreover, the display ratio may be arranged to be changed for each or every plural number of the scanning electrode, even though in the embodiment the display ratio is constant for each scanning electrode. For example, as shown in FIG. 19, when brightness at the center area is low, a display ratio for a scanning electrode (N−1)/3~2·(N−1)/3, which passes the center area, may be set at 60%, while the other scanning electrodes may be set at 50%. By doing this, it is possible to further improve the evenness in brightness.

Moreover, a smaller display ratio prevents blurring of moving picture due to accumulation effect on retina. Thus, it is possible to prevent the blurring of moving picture by the above embodiment.

Moreover, in the embodiment, the current is supplied from the upper end parts and the lower end parts of the transparent electrodes 10. However, the current may be supplied to the transparent electrodes 10 from one or more current supplying points inside the image display section, the one or more current supplying points being additionally provided by providing a contact hole or the like in the image display section 1.

In this case, the display ratio is set in accordance with shorter one of (i) a shortest distance on the transparent electrodes 10 from (a) the light emitting elements 9 of the pixels connected to the scanning electrode to (b) the current supplying ends 12, and (ii) a shortest distance on the transparent electrodes 10 from the light emitting element to the current supplying points.

Furthermore, in the present embodiment, the display scanning period from the start of the display scanning to the end of the scanning of all the columns is one field period in which the image of one screen is updated. However, there is a case in which the display scanning period is shorter than one field period, for example a case where the image of one screen is intermittingly displayed by repeating the display scanning and deleting scanning within one field period. In this case, it is necessary to have a shorter pixel display period, so that a ratio of the pixel display period to the display scanning period will be of a predetermined value that is less than 100%. The pixel display period can be shortened by shortening the period between the start of the display scanning and the start of the deletion scanning.

Moreover, in the display apparatus of the embodiment, the organic EL element is used as the light emitting elements 9. However, other light emitting elements such as inorganic EL elements, LED, and the like may be used.

As described above, a display-unit-use lighting control method of the present invention for a display unit including (i) a large number of electro-optic elements arrayed, the electro-optic elements having brightness that changes in accordance with a value of a current supplied thereto, and (ii) one or more power supplying conductors, connected to the electro-optic elements, for supplying power to the electro-optic elements, the lighting control method controlling lighting of the electro-optic elements, is so arranged that the lighting of the electro-optic elements is so controlled that an upper limit of a turn-ON ratio of (A) the electro-optic elements turned ON among the electro-optic elements connected respectively to the one or more power supplying conductors to (B) the total electro-optic elements connected respectively to the one or more power supplying conductors will be a predetermined value that is less than 100%.

Hereby, it is possible to suppress unevenness in the values of the current to be supplied to the electro-optic elements, without being dependent on contents of an image displayed.

Moreover, as described above, a display-unit-use display control method of the present invention, of controlling display of pixels in a display unit of a matrix type including a large number of electro-optic elements arrayed in a column direction and a row direction, and receiving power through one or more power supplying conductors so as to display the pixels that respectively correspond to the electro-optic elements, in order to display an image of one screen, is so arranged that each of the one or more power supplying conductors supplies power to the electro-optic elements, from one end part or each end part thereof in the column direction; and the display of the pixels is so controlled that a ratio of a pixel display period to a display scanning period will be a predetermined value that is less than 100%, the display scanning period being between start and end of the display scanning, and the pixel display period being between start of the display of a certain pixel by the display scanning and deletion of the display of the certain pixel by the deletion scanning.

Hereby, it is possible to keep the turn-ON ratio at the predetermined value of less than 100%. Thus, it is possible to alleviate the unevenness in brightness, without being dependent on the contents of the image displayed.

Therefore, it is possible to alleviate the unevenness in brightness by additionally providing simple process means. Thus, it is possible to prevent giving such large circuit size to the display apparatus including the display unit and the control means for performing the display scanning and the deletion scanning.

Furthermore, the display-unit-use display control method of the present invention, having the above arrangement, is so arranged that the predetermined value is set for each or every plural number of the lines in the row direction.

In addition, it is preferable that the predetermined value is set in accordance with shortest one of distances on the one or more power supplying conductors, the distances being between (i) the electro-optic elements in one line in the row direction and (ii) the one or each end part to which the power is supplied.

Moreover, in case where power is supplied to the one or more power supplying conductors, not only from the one or each end part in the column direction, but also from one or more current supplying points provided in the display unit, it is preferable that the predetermined value is set in accordance with shorter one of (i) shortest one of distances on the one or more power supplying conductors, the distances being between (a) the electro-optic elements in one line in the row direction and (b) the one or each end part to which the power is supplied, and (ii) shortest one of distances on the one or more power supplying conductors, the distances being between the electro-optic elements in one line in the row direction and the current supplying points.

In the above power supplying conductor, the currents flowing the electro-optic elements are substantially equal to each other, because the distances from (i) the position from which the power is supplied to (ii) the position at which the electro-optic elements are connected in the respective pixels, are substantially equal. Moreover, with respect to the pixels in different lines in the row direction, the current flowing the electro-optic elements in the pixels in one line are different from those in the pixels in the other line, because the distances to the power supplying conductor are different. Thus, the brightness becomes uneven.

Therefore, according to the above method, because the predetermined value is set for each or every plural number of the lines in the row direction, it is possible to alleviate the unevenness in brightness, which depends on the distance from the position from which the power is supplied, as described above.

Furthermore, as described above, a display apparatus of the present invention is provided with (a) a display unit including (i) a large number of electro-optic elements arrayed, the electro-optic elements having brightness that changes in accordance with a value of a current supplied thereto, and (ii) one or more power supplying conductors, connected to the electro-optic elements, for supplying power to the electro-optic elements, and (b) lighting control means for controlling lighting of the electro-optic elements, wherein the lighting control means is means for controlling lighting of the electro-optic element so that an upper limit of a turn-ON ratio of (A) the electro-optic elements turned ON among the electro-optic elements connected respectively to the one or more power supplying conductors to (B) the total electro-optic elements connected respectively to the one or more power supplying conductors will be a predetermined value that is less than 100%.

Hereby, it is possible to suppress unevenness in the values of the current to be supplied to the electro-optic elements, without being dependent on contents of an image displayed.

Further, as described above, a display apparatus of the present invention is provided with (i) a display unit of a matrix type, and (ii) display control means for controlling the display of the pixels by the display unit, wherein each of the one or more power supplying conductors supply power to the electro-optic elements, from one end part or each end part thereof in the column directions; the display control means including (a) display scanning means for performing the display scanning; (b) deletion scanning means for performing the deletion scanning; and (c) deletion scanning control means for controlling the deletion scanning means so that a ratio of a pixel display period to a display scanning period will be a predetermined value that is less than 100%.

Hereby, the upper limit of the turn-ON ratio is limited by the predetermined value. Thus, it is possible to alleviate the unevenness in brightness without being dependent on the content of the image displayed.

Moreover, the control of the pixel display period can be attained by additionally providing a simple process. Thus, it is possible to prevent giving such large circuit size to the display apparatus.

Furthermore, as described above, the display apparatus is so arranged that the deletion scanning control means includes a predetermined value setting means for setting the predetermined value for each or every plural number of the lines in the row direction.

It is preferable that the predetermined value setting means sets the predetermined value in accordance with shortest one of distances on the one or more power supplying conductors, the distances being between (i) the electro-optic elements in one line in the row direction and (ii) the one or each end part to which the power is supplied.

In case where the display unit further includes one or more current supplying points for supplying power to the one or more power supplying conductors, besides the one or each end part in the column direction, it is preferable that the predetermined value setting means sets the predetermined value in accordance with shorter one of (i) shortest one of distances on the one or more power supplying conductors, the distances being between the electro-optic elements in one line in the row direction, and (ii) shortest one of distances on the one or more power supplying conductors, the distances being between the electro-optic elements in one line in the row direction and the current supplying points.

With the above arrangement, because a predetermined value setting means sets the predetermined value for each or every plural number of the lines in the row direction, it is possible to alleviate the unevenness in brightness, which depends on the distance from the position from which the power is supplied, as described above.

INDUSTRIAL APPLICABILITY

The present invention provides (i) a display control method for a display unit, the method being capable of alleviating driving load of the power supplying conductor, or the electro-optic elements respectively connected with the power supplying conductor, and (ii) a display apparatus. According to this, it is possible to alleviate the unevenness in brightness, without giving a large circuit size, and without being dependent on the content of the image displayed.

The invention claimed is:

1. A display-unit-use lighting control method for a display unit including (i) an array of electro-optic elements, the electro-optic elements having brightness that changes in accordance with a value of a current supplied thereto, and (ii) one or more power supplying conductors, connected to the electro-optic elements, for supplying power to the electro-optic elements, the lighting control method comprising:

controlling the lighting of the electro-optic elements by selectively supplying power thereto via the power supplying conductors, the lighting being controlled so that an upper limit of a lighting period of each of the electro-optic elements connected respectively to the one or more power supplying conductors will be a predetermined value that is less than 100% of a time period currently displaying an image of one screen in the display unit;

wherein the electro-optic elements are arrayed in a column direction and a row direction; and wherein the predetermined value is set for each line or every plural number of lines less than all lines in the row direction.

2. The display apparatus according to claim 1, wherein the power supplying conductors include transparent electrodes.

3. A display-unit-use display control method of controlling display of pixels in a display unit of a matrix type including electro-optic elements arrayed in a column direction and a row direction, the electro-optic elements having brightness that changes in accordance with a value of a current supplied thereto, and receiving power through one or more power supplying conductors so as to display the pixels that respectively correspond to the electro-optic elements, in order to display an image of one screen, wherein:

each of the one or more power supplying conductors supplies power to the electro-optic elements, from one end part or each end part thereof in the column direction;

display scanning for displaying the image of one screen is carried out by (i) displaying, at once or one by one, the pixels aligned in one line in the row direction, and (ii) repeating the displaying, for the pixels aligned in other lines in the row direction;

deletion scanning for deleting the image of one screen is carried out by (iii) deleting, one by one, the pixels aligned in one line in the row direction, and (iv) repeating the deleting, for the pixels aligned in other lines in the row direction;

the display of the pixels is so controlled that an upper limit of a ratio of a pixel display period to a display scanning period will be a predetermined value that is less than 100%, the display scanning period being between start and end of the display scanning, and the pixel display period being between start of the display of a certain pixel by the display scanning and deletion of the display of the certain pixel by the deletion scanning, and the predetermined value being set for each or every plural number of lines less than all lines in the row direction.

4. The display-unit-use display control method as set forth in claim 3, wherein:

the predetermined value is set in accordance with a shortest one of distances on the one or more power supplying conductors, the distances being between (i) the electro-optic elements in one line in the row direction and (ii) the one or each end part to which the power is supplied.

5. The display-unit-use display control method as set forth in claim 3, wherein:

power is supplied to the one or more power supplying conductors, not only from the one or each end part in the column direction, but also from one or more current supplying points provided in the display unit;

the predetermined value is set in accordance with a shorter one of (i) shortest one of distances on the one or more power supplying conductors, the distances being between the electro-optic elements in one line in the row direction and (ii) shortest one of distances on the one or more power supplying conductors, the distances being between the electro-optic elements in one line in the row direction and the current supplying points.

6. A display apparatus, comprising (a) a display unit including (i) an array of electro-optic elements, the electro-optic elements having brightness that changes in accordance with a value of a current supplied thereto, and (ii) one or more power supplying conductors, connected to the electro-optic elements, for supplying power to the electro-optic elements, and (b) lighting control means for controlling lighting of the electro-optic elements, wherein:

the lighting control means is means for controlling lighting of the electro-optic elements so that an upper limit of a lighting period of each of the electro-optic elements connected respectively to the one or more power supplying conductors will be a predetermined value that is less than 100% of a time period currently displaying an image of one screen in the display unit, the electro-optic elements are arrayed in a column direction and in a row direction; and the predetermined value is set for each line or every plural number of lines less than all lines in the row direction.

7. A display apparatus comprising (i) a display unit of a matrix type including electro-optic elements arrayed in a column direction and a row direction, the electro-optic elements having brightness that changes in accordance with a value of a current supplied thereto, and receiving power through one or more power supplying conductors so as to display the pixels that respectively correspond to the electro-optic elements, in order to display an image of one screen, and (ii) display control means for controlling the display of the pixels by the display unit, wherein:

each of the one or more power supplying conductors supply power to the electro-optic elements, from one end part or each end part thereof in the column directions;

the display control means including:

display scanning means for performing display scanning for displaying the image of one screen by (i) displaying, at once or one by one, the pixels aligned in one line in the row direction, and (ii) repeating the displaying, for the pixels aligned in other lines in the row direction;

deletion scanning means for performing deletion scanning for deleting the image of one screen by (iii)

deleting, one by one, the pixels aligned in one line in the row direction, and (iv) repeating the deleting, for the pixels aligned in other lines in the row direction; and deletion scanning control means for controlling the deletion scanning means so that an upper limit of a ratio of a pixel display period to a display scanning period will be a predetermined value that is less than 100%, the display scanning period being between start and end of the display scanning, and the pixel display period being between start of the display of a certain pixel by the display scanning and deletion of the display of the certain pixel by the deletion scanning, the deletion scanning control means including predetermined value setting means for setting the predetermined value for each or every plural number of the lines less than all the lines in the row direction.

8. The display apparatus as set forth in claim 7, wherein:

the predetermined value setting means sets the predetermined value in accordance with a shortest one of distances on the one or more power supplying conductors, the distances being between (i) the electro-optic elements in one line in the row direction and (ii) the one or each end part to which the power is supplied.

9. The display apparatus as set forth in claim 7, wherein:

the display unit further includes one or more current supplying points for supplying power to the one or more power supplying conductors, besides the one or each end part in the column direction; and the predetermined value setting means sets the predetermined value in accordance with a shorter one of (i) shortest one of distances on the one or more power supplying conductors, the distances being between the electro-optic elements in one line in the row direction, and (ii) shortest one of distances on the one or more power supplying conductors, the distances being between the electro-optic elements in one line in the row direction and the current supplying points.

10. A display apparatus, comprising (a) a display unit including (i) an array of electro-optic elements, the electro-optic elements having brightness that changes in accordance with a value of a current supplied thereto, and (ii) one or more power supplying conductors, connected to the electro-optic elements, for supplying power to the electro-optic elements, and (b) a lighting control circuit for controlling lighting of the electro-optic elements, wherein:

the lighting control circuit controls lighting of the electro-optic elements so that an upper limit of a lighting period of each of the electro-optic elements connected respectively to the one or more power supplying conductors will be a predetermined value that is less than 100% of a time period currently displaying an image of one screen in the display unit;

the electro-optic elements are arrayed in a column direction and a row direction; and the predetermined value is set for each line or every plural number of lines less than all lines in the row direction.

11. The display apparatus as set forth in claim 10, wherein the electro-optic elements comprise light emitting diodes.

12. The display apparatus as set forth in claim 10, wherein the electro-optic elements comprise electroluminescent elements.

13. A display apparatus comprising (i) a display unit of a matrix type including a row and column array of electro-optic elements, the electro-optic elements having brightness that changes in accordance with a value of a current supplied thereto, and receiving power through one or more power supplying conductors so as to display pixels that respectively correspond to the electro-optic elements, in order to display an image of one screen, and (ii) a display control circuit for controlling the display of the pixels by the display unit, wherein:

each of the one or more power supplying conductors extend in the column direction and supply power to the electro-optic elements; and the display control circuit performs display scanning for displaying the image of one screen by (i) displaying, at once or one by one, the pixels aligned in one line in the row direction, and (ii) repeating the displaying, for the pixels aligned in other lines in the row direction;

performs deletion scanning for deleting the image of one screen by (iii) deleting, one by one, the pixels aligned in one line in the row direction, and (iv) repeating the deleting, for the pixels aligned in other lines in the row direction; and controls the deletion scanning so that a ratio of a pixel display period to a display scanning period is less than 100%, the display scanning period being between start and end of the display scanning, and the pixel display period being between start of the display of a certain pixel by the display scanning and deletion of the display of the certain pixel by the deletion scanning.

14. A display apparatus, comprising:

a display unit including electro-optic elements arrayed in rows and columns, the electro-optic elements having brightnesses that change in accordance with values of currents supplied thereto, and one or more power supplying conductors, connected to the electro-optic elements, for supplying power to the electro-optic elements; and a lighting control circuit for controlling lighting of the electro-optic elements, wherein the lighting control circuit controls lighting of the electro-optic elements so that an upper limit of a ratio between (i) a lighting period of lighted electro-optic elements connected to the one or more power supplying conductors and (ii) a display scanning period for an image of a single screen is less than 100%; and wherein a value of the ratio is variable for each row of electro-optic elements or for each of two or more groups of rows of electro-optic elements, each group of rows comprising less than a total number of rows in the array.

15. The display apparatus according to claim 14, wherein first ends of the power supplying conductors are connected to together and second ends of the power supplying conductors are also connected together.

16. The display apparatus according to claim 14, wherein the power supplying conductors include flat conductors.

17. A display-unit-use display control method of controlling display of pixels in a display unit of a matrix type including electro-optic elements arrayed in a column direction and a row direction, the electro-optic elements having brightness that changes in accordance with a value of a current supplied thereto, and receiving power through one or more power supplying conductors so as to display the pixels that respectively correspond to the electro-optic elements, in order to display an image of one screen, the method comprising:

supplying power from each of the one or more power supplying conductors to the electro-optic elements, from one end part or each end part thereof in the column direction;

displaying the image of one screen by (i) displaying, at once or one by one, the pixels aligned in one line in the row direction, and (ii) repeating the displaying, for the pixels aligned in other lines in the row direction;

deleting the image of one screen by (iii) deleting, one by one, the pixels aligned in one line in the row direction, and (iv) repeating the deleting, for the pixels aligned in other lines in the row direction; and controlling the display of the pixels so that an upper limit of a ratio of a pixel display period to a display scanning period will be a predetermined value that is less than 100%, the display scanning period being between start and end of the display scanning, and the pixel display period being between start of the display of a certain pixel by the display scanning and deletion of the display of the certain pixel by the deletion scanning, wherein the predetermined value is set for each or every plural number of lines less than all lines in the row direction.

* * * * *